US007234197B2

(12) United States Patent
Tran

(10) Patent No.: US 7,234,197 B2
(45) Date of Patent: Jun. 26, 2007

(54) UNATTENDED SPOT CLEANING APPARATUS

(75) Inventor: Phong Hoang Tran, Caledonia, MI (US)

(73) Assignee: Bissell Homecare, Inc., Grand Rapids, MI (US)

( * ) Notice: Subject to any disclaimer, the term of this patent is extended or adjusted under 35 U.S.C. 154(b) by 0 days.

(21) Appl. No.: 11/276,888

(22) Filed: Mar. 17, 2006

(65) Prior Publication Data

US 2006/0207052 A1 Sep. 21, 2006

Related U.S. Application Data

(60) Provisional application No. 60/594,206, filed on Mar. 18, 2005.

(51) Int. Cl.
*A47L 11/30* (2006.01)
*A47L 9/02* (2006.01)

(52) U.S. Cl. ..... 15/320; 15/346; 15/380

(58) Field of Classification Search ..... 15/320, 15/340.1, 340.2, 340.3, 340.4, 345, 346, 15/354, 380, 381, 385
See application file for complete search history.

(56) References Cited

U.S. PATENT DOCUMENTS

| | | | | |
|---|---|---|---|---|
| 1,240,799 | A | 9/1917 | Gray | |
| 1,766,425 | A * | 6/1930 | Brockway | 15/379 |
| 1,996,921 | A * | 4/1935 | Hoover | 15/375 |
| 2,712,119 | A | 6/1955 | Strubel | |
| 4,295,243 | A | 10/1981 | King | |
| 4,441,229 | A | 4/1984 | Monson | |
| 4,485,517 | A * | 12/1984 | Voigt | 15/246.5 |
| 4,729,534 | A | 3/1988 | Hill et al. | |
| 4,939,808 | A | 7/1990 | Roden et al. | |
| 5,197,160 | A * | 3/1993 | Smith | 15/306.1 |
| 5,318,158 | A | 6/1994 | Seasholtz | |
| 5,493,752 | A | 2/1996 | Crouser et al. | |
| 5,867,860 | A | 2/1999 | Harris | |
| 5,983,446 | A * | 11/1999 | Hsia | 15/354 |
| 6,003,200 | A | 12/1999 | Potts et al. | |
| 6,311,365 | B1 * | 11/2001 | Dornier | 15/302 |
| 6,446,302 | B1 | 9/2002 | Kasper et al. | |
| 6,467,122 | B2 | 10/2002 | Lenkiewicz et al. | |
| 2002/0092671 | A1 | 7/2002 | Stephens | |
| 2004/0200032 | A1 | 10/2004 | Morgan et al. | |
| 2004/0216264 | A1 | 11/2004 | Shaver et al. | |

FOREIGN PATENT DOCUMENTS

| | | |
|---|---|---|
| DE | 8521143 U | 2/1987 |
| DE | 4425782 A1 | 1/1996 |
| JP | 04-042099 | 2/1992 |

* cited by examiner

*Primary Examiner*—Terrence R. Till
(74) *Attorney, Agent, or Firm*—McGarry Bair PC

(57) ABSTRACT

A spot cleaning apparatus comprises a fluid distribution system, a fluid recovery system, an agitation system, and a controller system to automatically monitor and control inputs and outputs to said systems for removal of spots and stains from a surface without attendance by a user. A suction nozzle and agitation device are mounted to the housing for movement over the surface to be cleaned relative to a stationary housing. Optionally, the spot cleaning apparatus can be operated in a manual mode. In one embodiment, the spot cleaning apparatus comprises a controller for continuously reversing the agitation direction of the agitatation system. In another embodiment, the spot cleaning apparatus comprises a modular strain relief assembly. In yet another embodiment, working air is recirculated to the surface to be cleaned through internal ducting.

4 Claims, 28 Drawing Sheets

UNATTENDED SPOT CLEANING APPARATUS

CROSS-REFERENCE TO RELATED APPLICATION

This application claims the benefit of U.S. Provisional Application Ser. No. 60/594,206, which is incorporated herein by reference in its entirety. This application is related to PCT Application Publication No. WO2004/089179 filed Mar. 31, 2004 which claims the benefit of U.S. Provisional Application Ser. No. 60/320,071, filed Mar. 31, 2003, both of which are incorporated herein by reference in their entirety.

BACKGROUND OF THE INVENTION

1. Field of the Invention

This invention relates to extraction cleaning devices. In one of its aspects, the invention relates to an extraction-cleaning machine that is adapted to clean spots in carpet and other fabric surfaces. In yet another aspect, the invention relates to an extraction cleaning machine with an improved scrubbing or agitation implement. In yet another aspect, the invention relates to an extraction cleaning machine with an air purifier. In yet another aspect, the invention relates to a spot cleaner for carpet and bare floors that can function unattended by a user. In yet another of its aspects, the invention relates to a floor cleaning apparatus that has a cord wrap that can be retracted into the apparatus housing when not in use. In yet another of its aspects, the invention relates to an electrical appliance with a modular strain relief assembly. In still another of its aspects, the invention relates to a floor cleaning apparatus wherein with a peripheral seal around a cleaning cavity and air for suction is internally supplied to the sealed cleaning cavity. In yet another of its aspects, the invention relates to a floor cleaning apparatus wherein the airflow through the apparatus is recirculated. In yet another of its aspects, the invention relates to an extraction cleaning machine with a bi-directional scrubbing.

2. Description of the Related Art

Japanese Patent Application Publication No. 04-042099, published Feb. 12, 1992, discloses a stationary floor cleaning device for removal of radioactive material. To operate the device, the user manually selectively actuates three electrical switches to activate a vacuum motor, a fluid delivery pump or a rotating brush.

U.S. patent application Ser. No. 09/755,724, published on Dec. 6, 2001, discloses an upright deep cleaning extraction machine comprising a base movable across the surface to be cleaned, an upright handle pivotally attached to the base, a fluid distribution system, a recovery system and an agitation system. The fluid distribution system comprises a clean fluid tank, a delivery valve and a spray nozzle, each of which are in fluid communication via a conduit. Upon activation of the delivery valve, fluid is delivered under force of gravity through the spray nozzle and onto the surface being cleaned. A suction nozzle is located at a forward end of the base and provides an entry point for liquid extraction through a working air conduit that is in fluid communication with a dirty water recovery tank. A vacuum motor driving a fan is positioned downstream of the recovery tank to create a working airflow. A rotating scrubbing implement is mounted horizontally in spaced relation behind the suction nozzle. The brush can be rotated via a belt driven by the vacuum motor or alternatively via an air driven turbine.

U.S. Pat. No. 6,446,302 to Kasper et al. discloses an extraction cleaning machine with floor condition sensing devices and controllers for the cleaning operation. A controller sends signals to a variable control cleaning system in response to signals received from the condition sensors. The condition sensors and controllers are mounted to an upright deep cleaner wherein movement of the cleaner can be accomplished by motive force generated by the user.

U.S. patent application Ser. No. 10/065,891 to Lenkiewicz discloses a commercially available portable extraction cleaning device known as the BISSELL Little Green Clean Machine Model 1400, 1425, or 1425-1 that incorporates a fluid distribution and recovery system similar to that of a larger extraction device in a smaller configuration.

SUMMARY OF THE INVENTION

A floor cleaning apparatus according to the invention comprises a housing with a bottom portion that is adapted to rest on a surface being cleaned and an opening in an underside of the housing to define an enclosed chamber between the surface to be cleaned and an interior portion of the housing, a carriage support mounted in the enclosed chamber in the housing above the opening in the underside of the housing, an extraction system including a suction nozzle for recovering soil from the surface to be cleaned beneath the opening in the underside of the housing and a suction source having an inlet fluidly connected to the suction nozzle to create a working air flow, a carriage mounting the suction nozzle to the carriage support for translational movement with respect to the housing so that the suction nozzle moves laterally with respect to the housing and along the surface to be cleaned, a working air path that carries working air from the suction source to the suction nozzle, and an exhaust air passage between an outlet of the suction source and the enclosed chamber.

Further, according to the invention, a floor cleaning apparatus comprises a housing with a bottom portion that is adapted to rest on a surface being cleaned, a carriage support is positioned above an opening in an underside of the housing, a fluid delivery system includes a fluid distributor for delivering a cleaning fluid to the surface to be cleaned beneath the opening in the underside the housing, a fluid extraction system includes a suction nozzle for recovering soiled cleaning fluid from the surface to be cleaned beneath the opening in the underside of the housing, a carriage mounting the fluid distributor and the suction nozzle to the carriage support for translational movement with respect to the housing so that the suction nozzle and the fluid distributor move laterally with respect to the surface to be cleaned, a motor mounted to the housing and connected to the carriage for driving the movement of the carriage with respect to the housing, and a controller for selectively controlling the direction of the motor for sequential movement of the carriage in two mutually exclusive directions.

In one embodiment, the movement can be arcuate. In another embodiment, the movement can be orbital. In a preferred embodiment, the floor cleaning apparatus can include a scrubbing implement mounted to the carriage for movement with the fluid distributor and the suction nozzle and for scrubbing contact with the surface to be cleaned.

Further, according to the invention, a strain relief assembly for an appliance having an appliance housing and an electrical element mounted in the appliance housing and connected to an electrical cord for supplying power to the electrical element, the electrical cord extending into the appliance housing through the strain relief assembly comprises a first and second strain relief housing portions defining a wall that has an inlet aperture and an outlet aperture formed therein juxtaposed to one another and a U-shaped passageway for passage of the electrical cord therethrough between the inlet aperture and the outlet aperture. The portions of the electrical cord that pass through the inlet and outlet aperture can be parallel to each other. The portion of the electrical cord passing through on outlet aperture can be surrounded by a resilient collar that forms a bend relief device. The resilient collar can have at least one flange at one end that is received in a retaining cavity formed between the first and second strain relief housing portions at the outlet aperture. The inlet aperture can lie within the appliance housing and the outlet aperture can lie outside the appliance housing. A seating ridge can be formed on the first and second strain relief housing portions and abuts the appliance housing. At least one rib can be formed on at least one of the first and second strain relief housing portions and extends into the U-shaped passageway to make an interference contact with the electrical cord. A pair of resilient tabs can be formed on the first and second strain relief housing portions that resiliently deflect for insertion of the strain relief assembly through an opening in the appliance housing and the seat behind the appliance housing after insertion through the opening. Each of the first and second strain relief housing portions can have a boss extending toward each other and forming a portion of the U-shaped passageway. The bosses can have an opening therethrough for receiving a fastener that secures the first and second strain relief housing portions together.

DETAILED DESCRIPTION OF THE PREFERRED EMBODIMENTS

Figure 1:
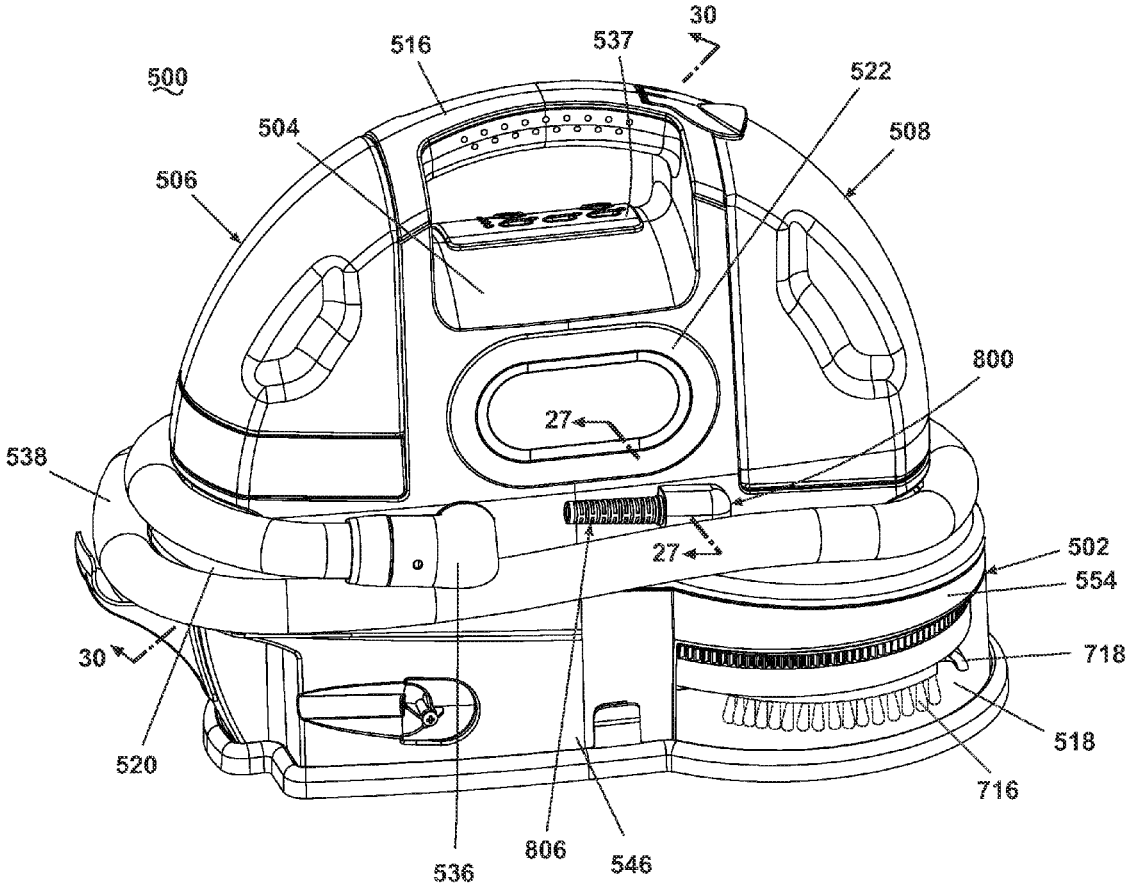
FIG. 1 is a rear perspective view of a sixth embodiment of an unattended spot cleaning apparatus showing a modular strain relief according to the invention.
Figure 2:
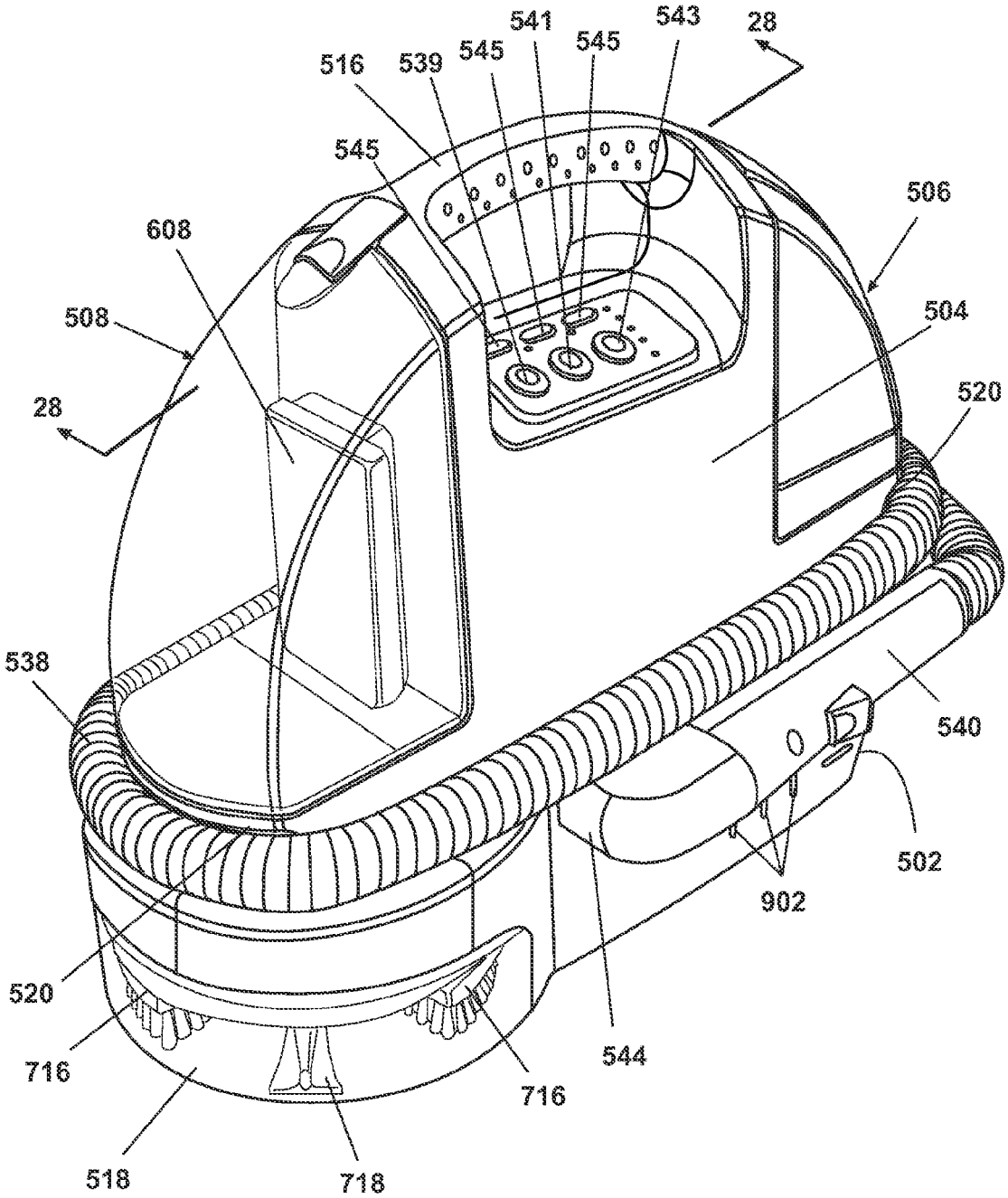
FIG. 2 is a front perspective view of the unattended spot cleaning apparatus shown in FIG. 1.
Figure 3:
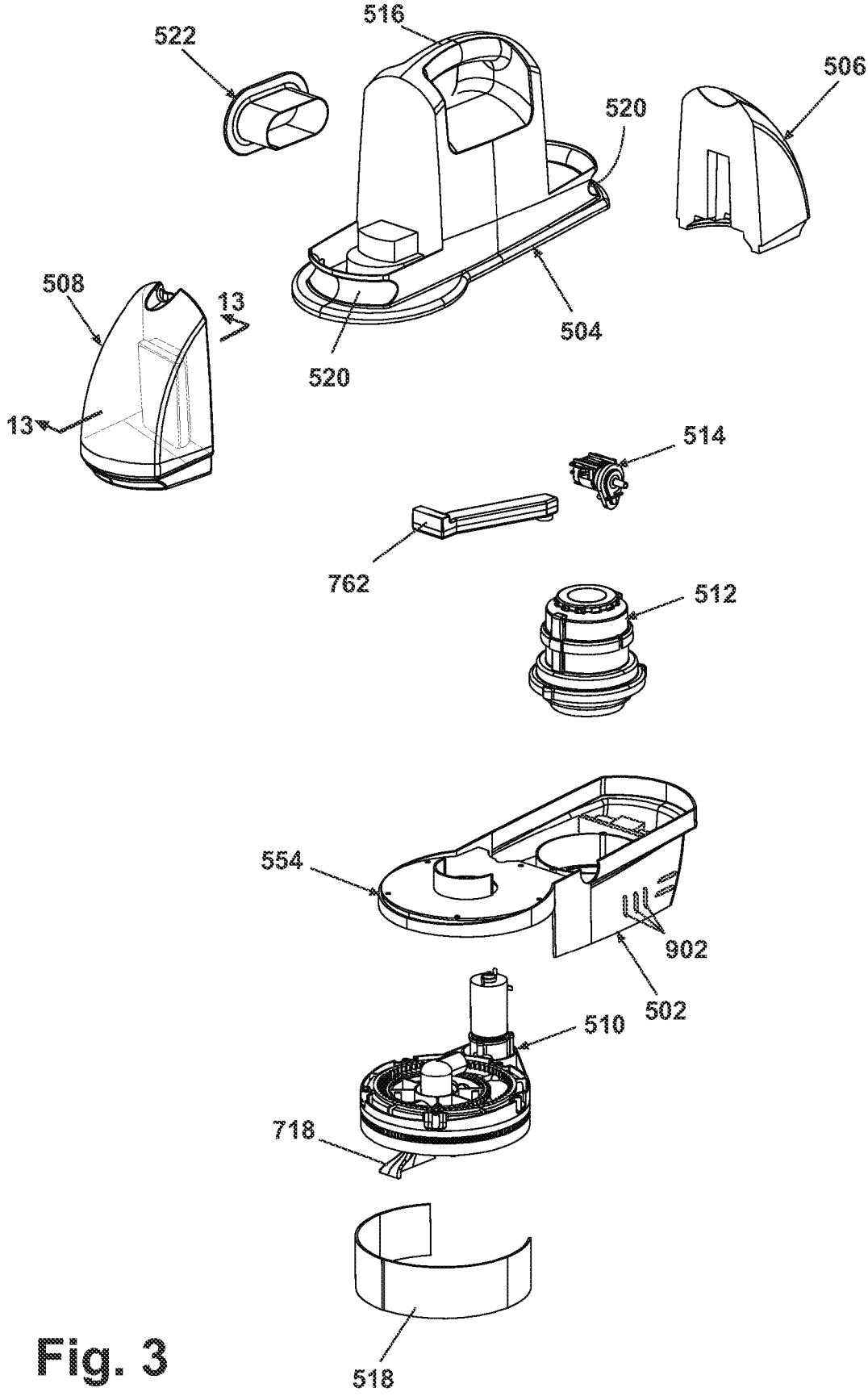
FIG. 3 is an exploded view of the unattended spot cleaning apparatus shown in FIG. 1.
Figure 4:
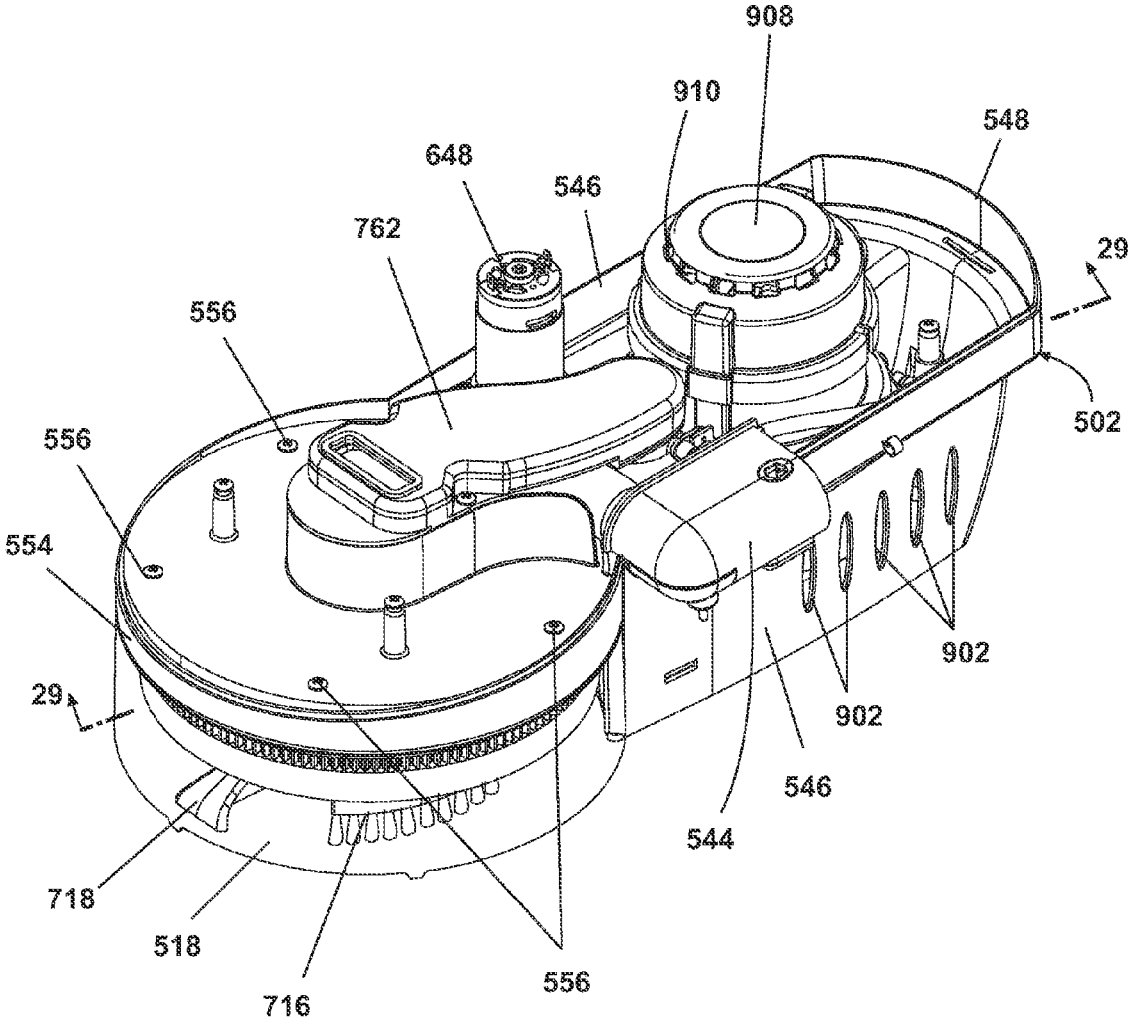
FIG. 4 is a top perspective view of a bottom housing of the unattended spot cleaning apparatus shown in FIG. 1.

Referring to the drawings and in particular to FIGS. 1–3, a spot cleaning apparatus 500 for unattended or manual cleaning of spots and stains on carpeted surfaces according to the invention is illustrated. The spot cleaning apparatus 500 comprises a bottom housing or portion 502, a top housing or portion 504, a clean tank assembly 506, a recovery tank assembly 508, a carriage assembly 510, a motor/fan assembly 512, and a pump assembly 514. The bottom housing 502 rests on a surface to be cleaned, and the top housing 504 and the bottom housing 502 mate to form a cavity therebetween. A handle 516 is integrally formed at an upper surface of the top housing 504 to facilitate easy carrying of the spot cleaning apparatus 500. A carriage assembly lens 518 is attached to a forward lower section of the bottom housing 502 to define an opening in the underside of the bottom housing 502 and is preferably made from a transparent material for visibility of the carriage assembly 510 located behind the carriage assembly lens 518. Hose recesses 520 are integrally formed in a lower surface of the top housing 504 in forward and rearward locations. For explanatory purposes, the forward direction of the spot cleaning apparatus 500 is defined by the location of the carriage assembly 510 and the carriage assembly lens 518. The rearward direction is opposite of the forward direction. While a preferred embodiment of the spot cleaning apparatus 10 is described herein, further details and embodiments of the spot cleaning apparatus 10 are disclosed in PCT Application Publication No. WO2004/089179, which is incorporated herein by reference in its entirety.

A cord wrap 522 is slidably mounted to a side surface of the top housing 504 and, in an extended position, supports a power cord (not shown) for easy storage thereof Details of a suitable cord wrap 522 can be found in the above referenced PCT application. The power cord is mounted to the top housing 504 with a modular strain relief assembly 800, as will be described in more detail below.

A plurality of floor condition sensors (not shown) can be positioned to effectively scan the entire area within the carriage assembly lens 518 and measure the relative degree of soil on the surface being cleaned by sensing color variation. The floor condition sensors are mounted such that the entire area within the carriage lens assembly 518 is monitored. Each sensor can provide signals relative to the condition of the surface being cleaned to a controller 106 (FIG. 8) for processing. One such example of a controller and floor condition sensors is disclosed in U.S. Pat. No. 6,446,302 to Kasper et al., which is incorporated herein by reference in its entirety. Alternatively, the controller 106 can utilize pre-timed programs in the fashion of a commonly known laundry washing machine timing circuit. In an alternate embodiment, the controller output signals are routed to a plurality of visual or audible indicators mounted to the exterior of the enclosure. Indicators can include Light Emitting Diodes (LED's) or signal tone generators. Indicators can convey information such as low fluid, the present stage of the cleaning cycle, or the like.

The controller 106 comprises a commonly known printed circuit board upon which commonly known computer processing and electronic components are mounted. The controller 106 receives inputs from the various condition sensors and provides conditioned output to any combination of components of the spot cleaning apparatus, such as a the carriage assembly 510, the motor/fan assembly 512, and the pump assembly 514, and other components of the fluid delivery and extraction systems as will be described in more detail below.

Referring to FIG. 2, a control panel 537 comprises a bezel to retain a first operational mode switch 539, a second operational mode switch 541, a manual switch 543, and a plurality of corresponding indicator lights 545 that visually communicate the operational mode of the spot cleaning apparatus 500 to the user. In use, the user selects the desired operational mode by engaging the appropriate switch 539, 541, or 543, which thereby sends an appropriate signal to the controller 106. The controller 106 then sends appropriate output signals to components of the spot cleaning apparatus 500, as will be discussed in more detail below, as well as a signal to the appropriate indicator light 545 to communicate the operational mode to the user.

The top housing 504 further comprises a suction hose assembly that can be detached at one end from the spot cleaning apparatus for cleaning in a manual mode or attached to the spot cleaning apparatus at both ends during an automatic mode. The suction hose assembly comprises a suction hose fitting 536 preferably located on the same side as the cord wrap 522. A flexible suction hose 538 is fixedly attached to and is in fluid communication with the suction hose fitting 536 via a commonly known connector. A suction hose grip 540 is fixedly attached to an opposite end of the flexible suction hose 538. A suitable suction hose assembly is disclosed in U.S. patent application Ser. No. 10/065,891 to Lenkiewicz, which is incorporated herein by reference in its entirety. A hose grip fitting 544 is fixedly attached between the top housing 504 and the bottom housing 502 to removably retain the hose grip 540 to the spot cleaning apparatus 500. Various cleaning attachments can be removably mounted to the hand grip 540 to manually perform specialized cleaning tasks in addition to or separate from the automatic unattended function of the spot cleaning apparatus 500. When the suction hose 538 is not utilized (i.e. during an automatic mode), it can be wrapped around the top housing 504 so that the hose 538 rests in the hose recesses 520 and the hose grip 540 is retained by the hose grip support.

Referring to FIGS. 4–7, the bottom housing 502 forms an air flow path for both the working air and the motor cooling air. The bottom housing 502 comprises a pair of generally parallel side walls 546 joined by a slightly arcuate rear wall 548 on a rear end and a carriage assembly support 554 on a forward end. Each side wall further comprises a plurality of motor cooling air inlet apertures 902. A motor cooling outlet aperture 904 is located on a rearward portion of the bottom housing 502 but it will be appreciated that the cooling outlet aperture 904 can be in any location on the bottom housing 502 that is in fluid communication with the external atmosphere. A motor cover 908 has a plurality of inlet apertures 910 and surrounds the motor/fan assembly 512, creating an intake cooling plenum 912 therebetween.

Figure 5:
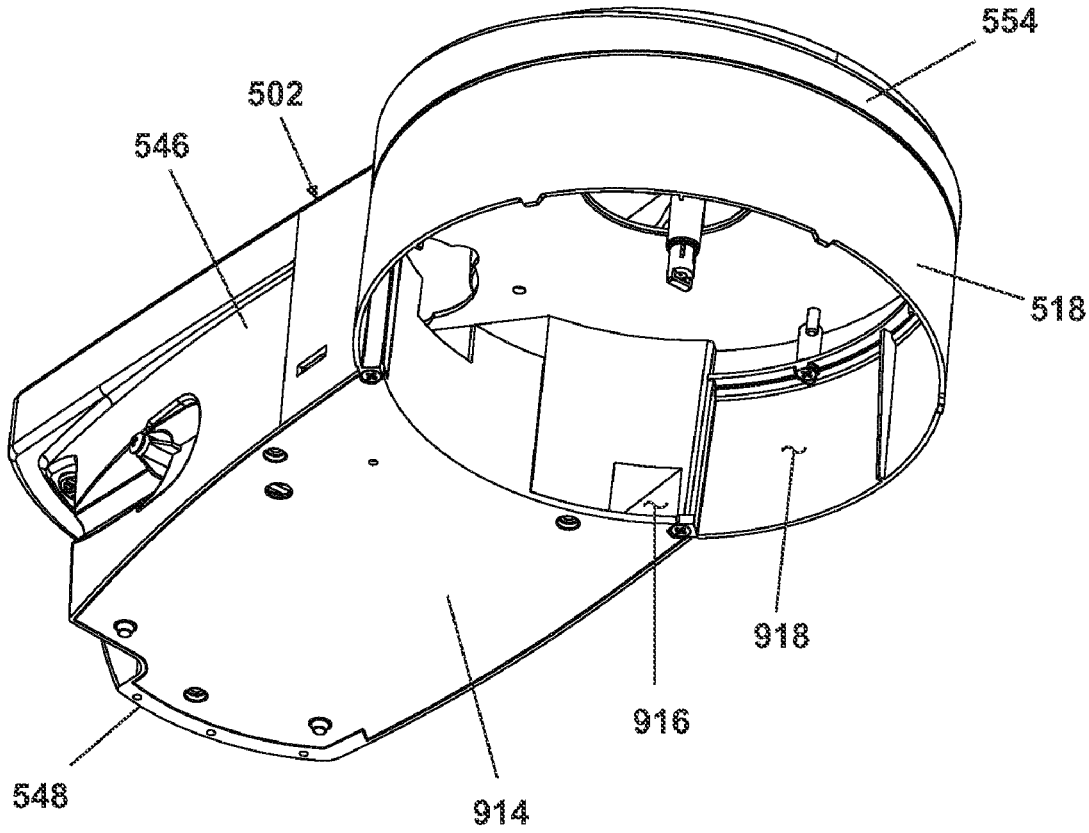
FIG. 5 is a bottom perspective view of the bottom housing of the unattended spot cleaning apparatus shown in FIG. 4.
Figure 6:
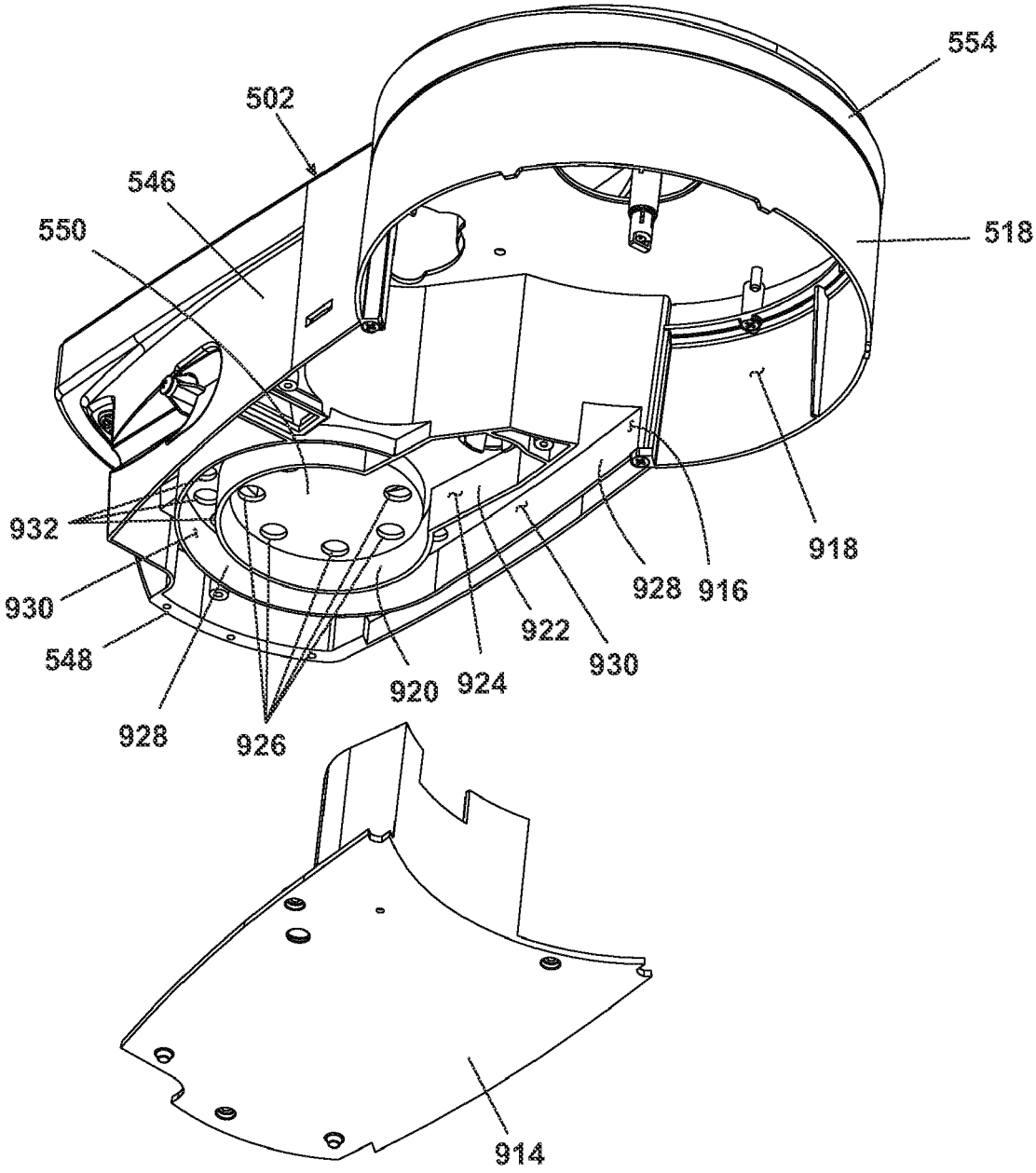
FIG. 6 is a partially exploded view of the bottom housing of the unattended spot cleaning apparatus shown in FIG. 4.
Figure 7:
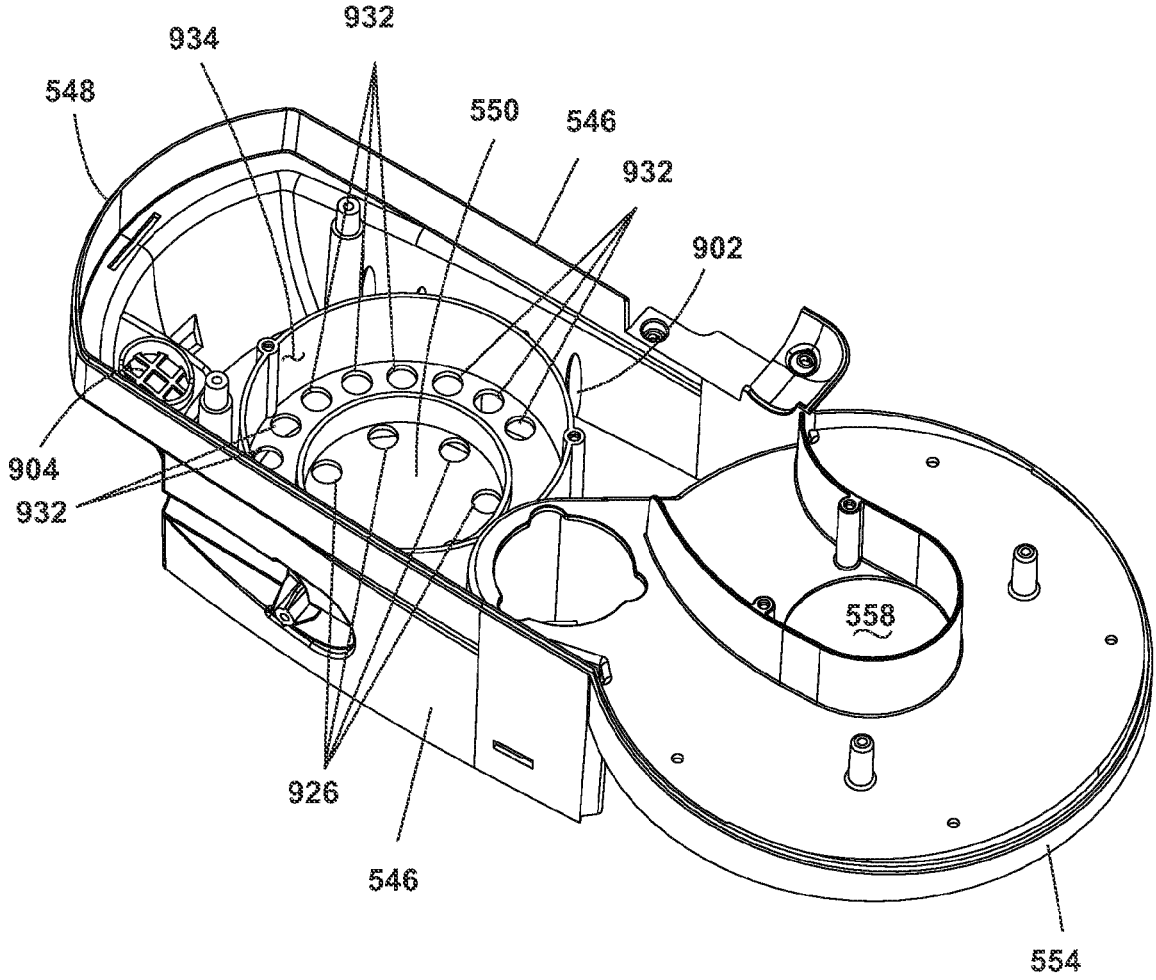
FIG. 7 is a top perspective view of the bottom housing of the unattended spot cleaning apparatus with components removed.

Referring to FIGS. 5 and 6, a bottom housing cover 914 mates with a lower end of the side walls 546 and rear wall 548 and also forms a bottom surface of a working air return aperture 916 that is in fluid communication with a cleaning plenum 918 formed between an inner surface of the carriage assembly lens 518, the bottom surface of the carriage assembly 510 and an upper surface of the surface to be cleaned. A generally circular motor/fan support 550 is integrally formed in an upper surface of a lower portion of the bottom housing 502 to locate and support the motor/fan assembly 512. A generally circular working air inlet wall 920 depends orthogonally from the lower surface and includes a pair of generally parallel extension walls 922 that together with the bottom housing cover 914 and motor/fan support 550 form a working air inlet channel 924. A plurality of working air inlet apertures 926 are formed in the motor/fan support 550 and are in fluid communication with the fan inlet of the motor/fan assembly 512. A working air outlet wall 928 also depends orthogonally from the lower surface and is generally concentric with the working air inlet wall 920 and forms a working air outlet channel 930. A plurality of working air outlet apertures 932 are also formed in the motor/fan support 550 and are in fluid communication with the working air exhaust of the motor/fan assembly 512 and the working air outlet channel 930. The working air outlet channel 930 is in fluid communication with the working air return aperture 916.

Figure 8:
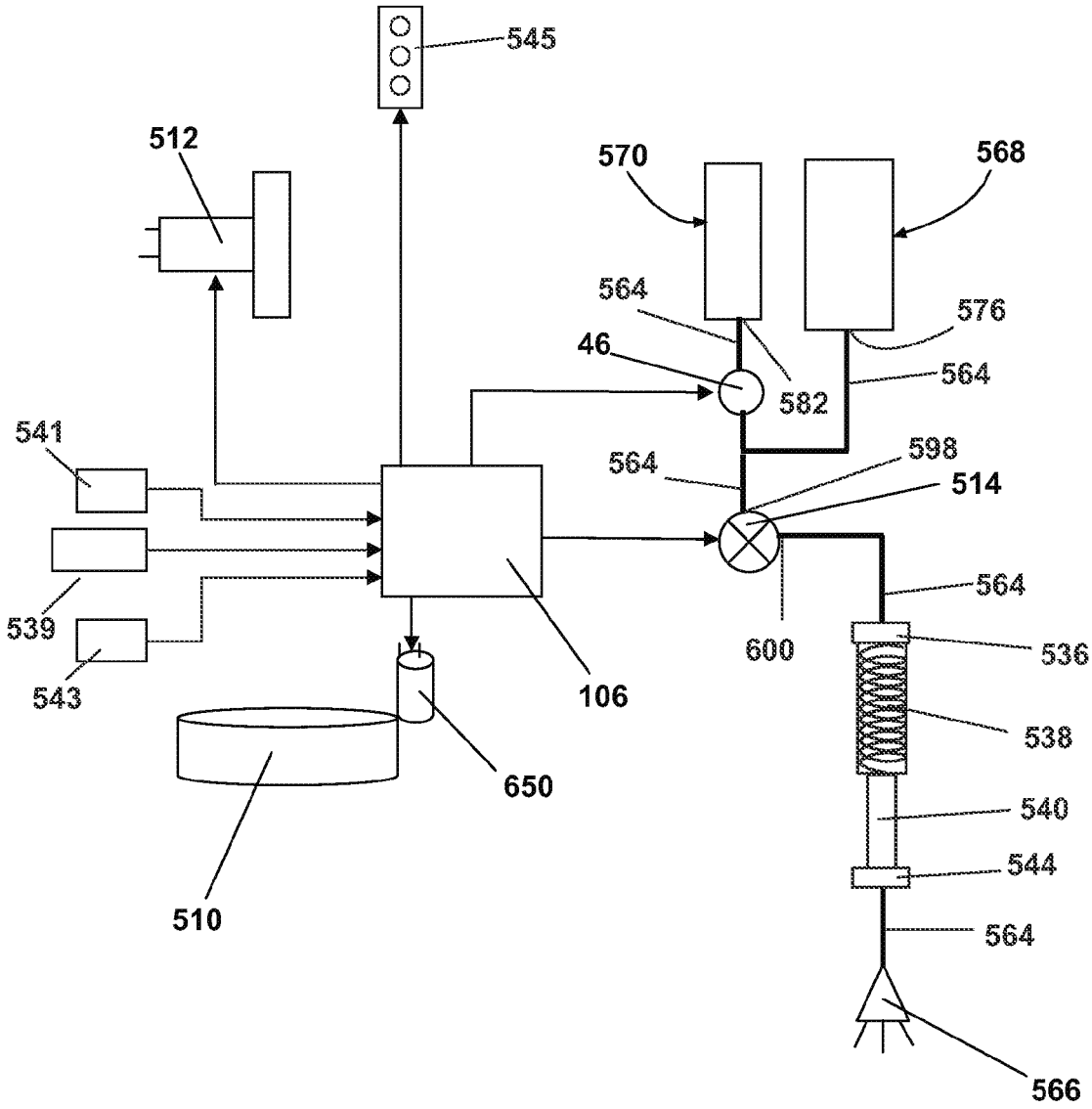
FIG.8 is a schematic view of a logic circuit of the unattended spot cleaning apparatus shown in FIG. 1.
Figure 9:
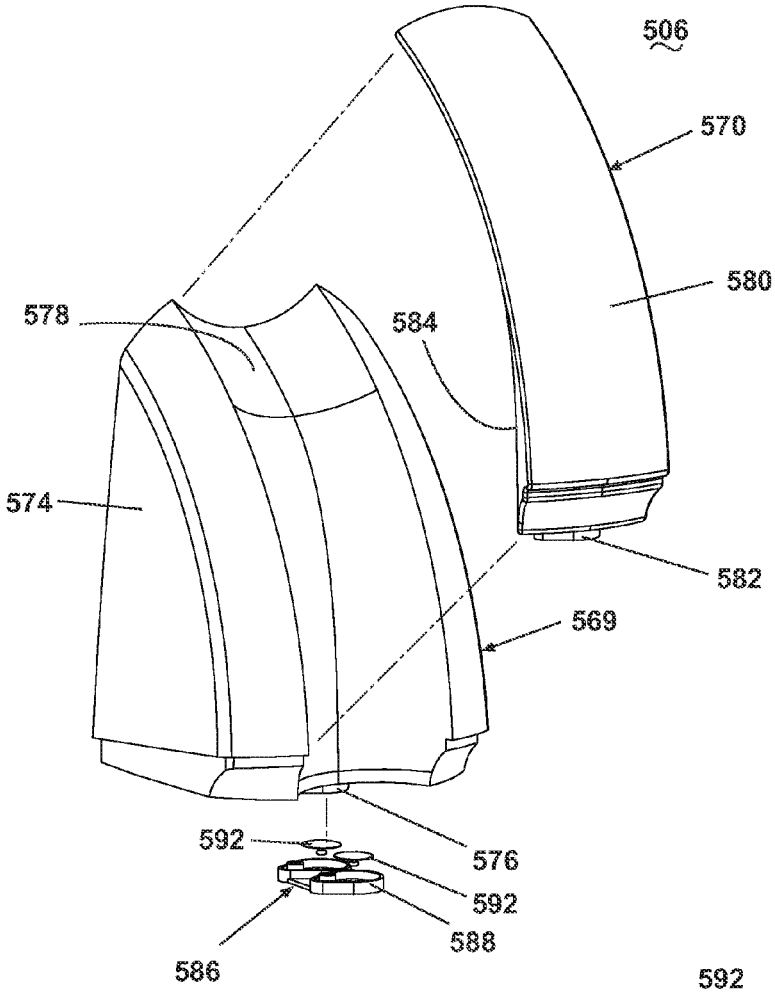
FIG. 9 is an exploded view of a clean tank assembly of the unattended spot cleaning apparatus shown in FIG. 1.

Referring to FIGS. 8–9, a fluid delivery system comprises the clean tank assembly 506, a pump assembly 514, various fluid supply conduits 564, and at least one fluid distribution member 566. The clean tank assembly 506 comprises a first fluid tank assembly 568, a second fluid tank assembly 570, and a clean tank cap assembly 586. The first fluid tank assembly 568 comprises a blow molded fluid tank 574 with a single outlet aperture 576 disposed on a bottom surface thereof. The first fluid tank 574 defines a cavity for storing a first fluid. A recess 578 is formed in one surface of the first fluid tank 574 for nestingly receiving the second fluid tank assembly 570. The recess 578 and the second fluid tank assembly 570 are dimensioned such that the assembled fluid tank assemblies 568, 570 have the appearance of a single unit with a smooth, uniform outer surface. The second fluid tank assembly 570 comprises a blow molded second fluid tank 580 with a single outlet aperture 582 disposed on a bottom surface thereof similar to the first fluid 574. The second fluid tank 580 comprises a protruding rear wall 584 that nestingly mates with the recess 578 on the first fluid tank 574. The second fluid tank 580 defines a cavity for storing a second fluid. Both outlet apertures 576, 582 are sealingly covered by the cap assembly 586.

Figure 10:
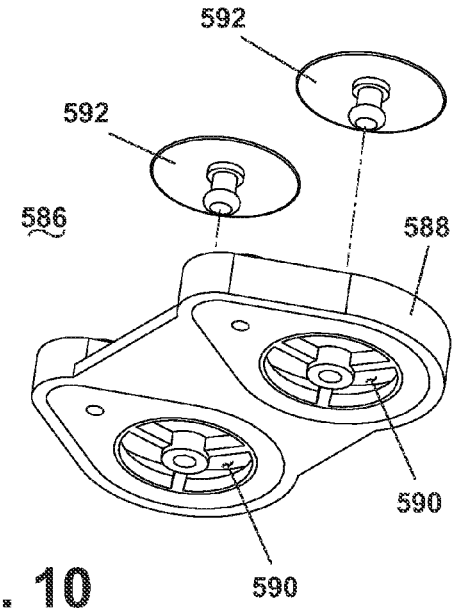
FIG. 10 is a perspective view of a cap assembly from the clean tank assembly shown in FIG. 9.

Referring to FIG. 10, in the preferred embodiment, the cap assembly 586 is a single cap frame 588 with at least two cap apertures 590 corresponding to the outlet apertures 576, 582. A commonly known umbrella valve 592 selectively seals the cap apertures 590. Desired mixing ratios between the first fluid drawn from the first fluid tank assembly 568 and the second fluid drawn from the second fluid tank assembly 570 are determined by the orifice size of the apertures 590. The spot cleaning apparatus 500 can include a solenoid mixing valve 46 that is electrically actuated and capable of varying the flow mixture of fluids from the first fluid tank assembly 568 and the second fluid tank assembly 570. The solenoid mixing valve can be operably coupled the controller 106 An example of a suitable mixing valve is disclosed in U.S. Pat. No. 6,131,237 to Kasper, which is incorporated herein by reference in its entirety. Ratio of fluid mixtures can range from 100/0 first fluid/second fluid to 0/100 first fluid/second fluid. The preferred ratio of the first fluid from the first fluid tank assembly 568 to the second fluid from the second fluid tank assembly 570 is 80/20. Preferably, the first fluid is a 4% by weight hydrogen peroxide is mixed with 95% by weight distilled water, and the second fluid is a commonly known carpet cleaning detergent. Alternatively, the first fluid is a cleaning solution, such as a commonly known carpet cleaning composition, and the second fluid is a clear fluid, such as water. However, it is within the scope of the invention for the first and second fluids to comprise other types of fluids and for the first fluid to be the same as the second fluid. Optionally, either the first fluid or the second fluid can be distributed without mixing with the other of the first fluid or the second fluid. For example, the first fluid can be distributed without dilution by the second fluid for concentrated cleaning, or the second fluid can be distributed alone for rinsing.

Venting for the first and second fluid tank assemblies 568, 570 can be accomplished in a conventional manner, such as vent holes in an upper surface thereof, or vent tubes can be inserted into the fluid tanks 574, 580 and vented to the atmosphere through the cap assembly 586 in a manner similar to that found in U.S. Pat. No. 6,125,498 to Roberts et al., which is incorporated herein by reference in its entirety.

In the preferred embodiment, the fluid tanks 574, 580 are pre-filled through the outlet apertures 567, 582 with a predetermined amount of the first and second fluids and sealed with the cap assembly 586 to form a captive system wherein the fluid tanks 574, 580 can not be refilled by the user. The clean tank assembly 506 is preferably purchased in this pre-filled state and is disposable when the supply of fluids therein is depleted. Alternatively, the cap assembly 586 can be multiple pieces that correspond to the respective outlet apertures 576, 582 and are removable so that the user can refill the first and second fluid tank assemblies 568, 570 as needed.

Figure 11:
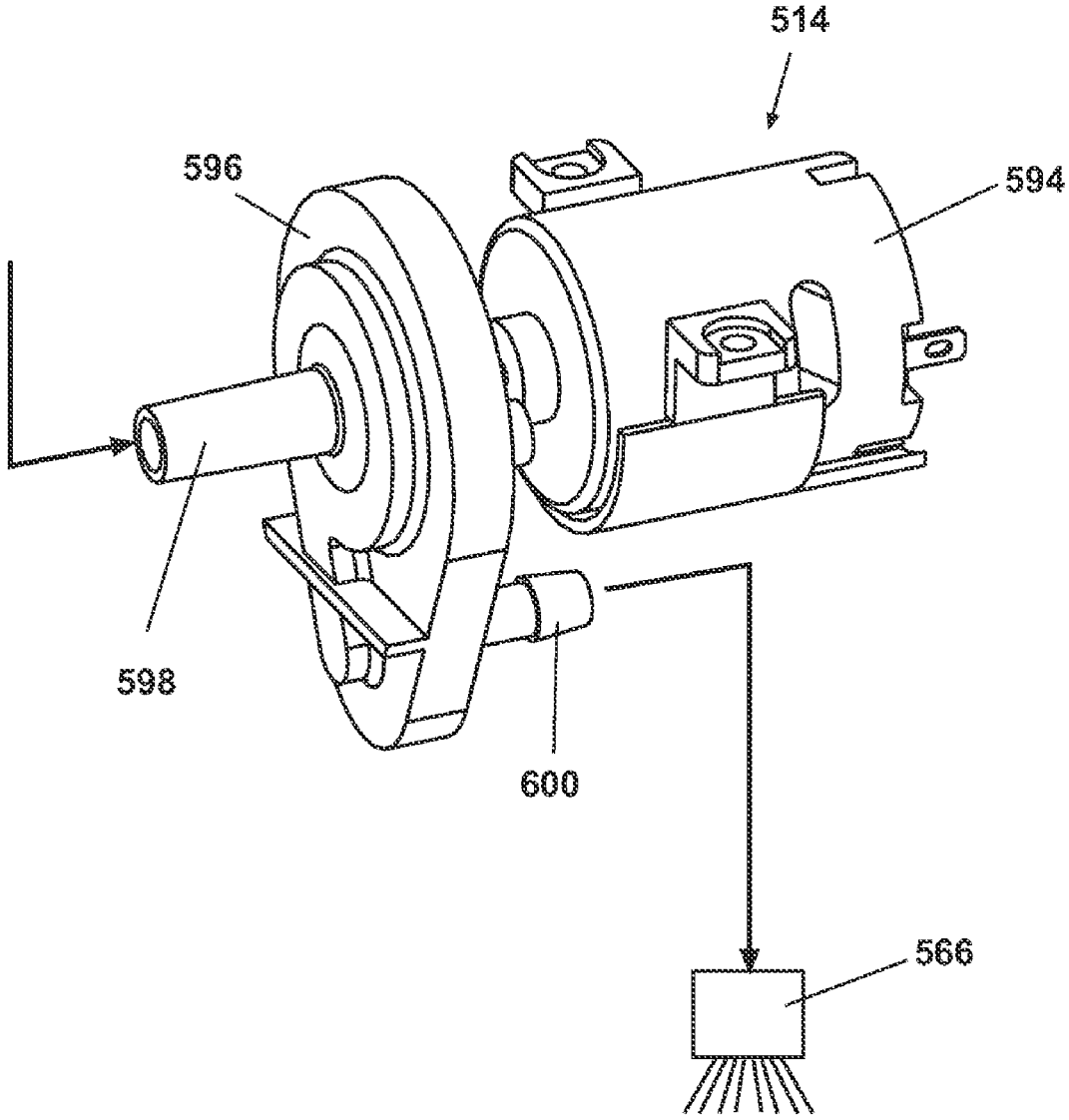
FIG. 11 is a perspective view of a pump assembly of the unattended spot cleaning apparatus shown in FIG. 3.

Referring to FIGS. 8 and 11, the clean tank assembly 506 is located directly above the pump assembly 514. The pump assembly 514 is mounted to a rear surface of the motor/fan support 550 (FIG. 7) in the bottom housing 502. The pump assembly 514 comprises an electric motor 594 with a shaft directly coupled to a commonly known mechanical fluid pump 596 similar to that found in the BISSELL Spot Lifter Model 1725 and as disclosed in the above referenced Roberts '498 patent. The fluid pump 596 comprises a pump inlet 598 and a pump outlet 600. A pair of fluid conduits 564 fluidly communicates the outlet apertures 576, 582 with a common "T" fitting (not shown) on another end. A first fluid conduit 564 fluidly communicates the "T" fitting on one end with the pump inlet 598 on another end. The fluid from the respective tanks 568, 570 mix in the "T" fitting and the first fluid conduit 564 and are drawn into the fluid pump 596, which further mixes the fluids. Mixed fluid is expelled from the fluid pump 596 through the pump outlet 600. A second fluid conduit 564 fluidly communicates the pump outlet 600 with a fluid fitting (not shown) within the suction hose fitting 536. A third fluid conduit (not shown) runs from the fluid fitting and along the length of the suction hose 538. At the end of the suction hose 538, the third fluid conduit is fluidly connected to the grip support fitting 544. When the suction hose grip 540 is coupled to the grip support fitting 544, the third fluid conduit is fluidly connected to a fourth fluid conduit 564 that is connected to the grip support fitting 544 on one end. On the other end, the fourth fluid conduit 564 is connected to the at least one fluid distribution member 566 preferably located underneath the carriage assembly support 554 on the bottom housing 502. At the fluid distribution member 566, the mixed fluid is applied to the surface to be cleaned. In one embodiment, the fluid distribution member 566 is a conventional spray nozzle preferably mounted to the carriage assembly 510. In another embodiment, a fluid conduit terminates above the carriage assembly 510, and fluid drips to the surface to be cleaned. In yet another embodiment, the fluid distribution member 566 is a manifold with spaced openings. When the suction hose grip 540 is removed from the grip support fitting 544, the user can manually apply fluid to the surface to be cleaned.

Figure 12:
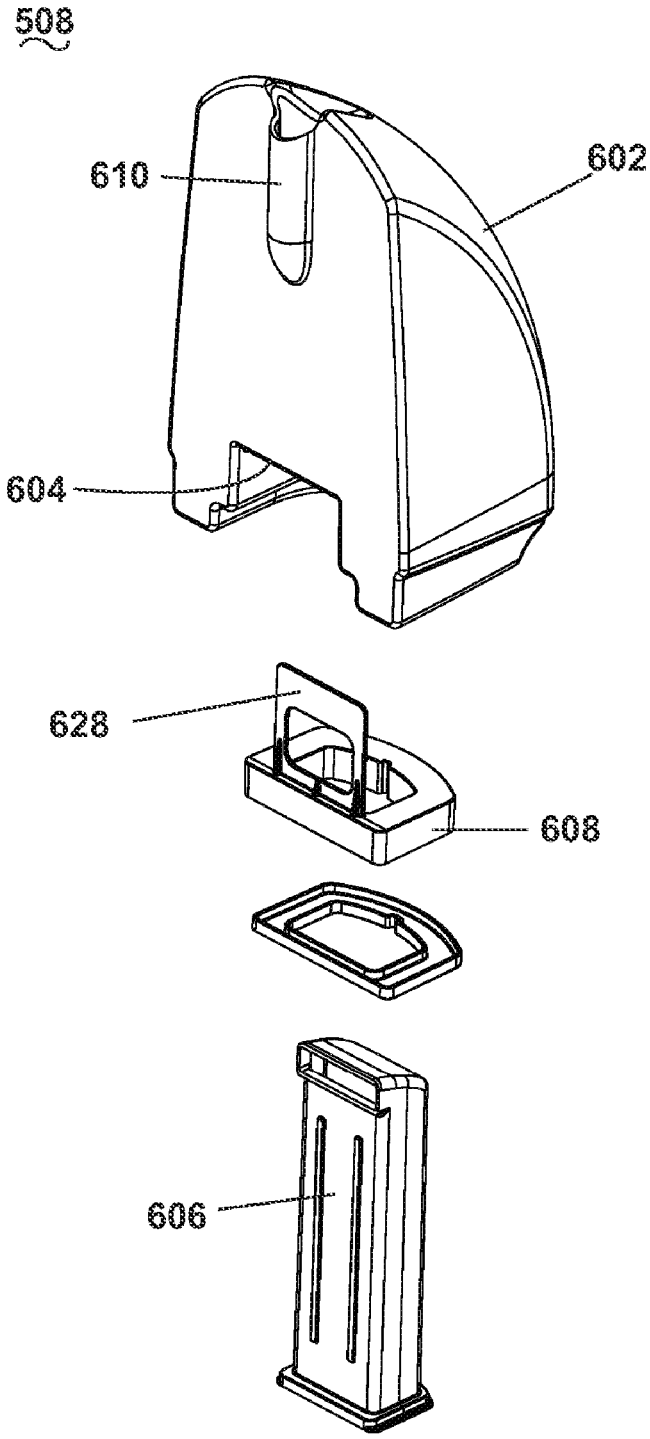
FIG. 12 is an exploded view of a recovery tank assembly of the unattended spot cleaning apparatus shown in FIG. 1.
Figure 13:
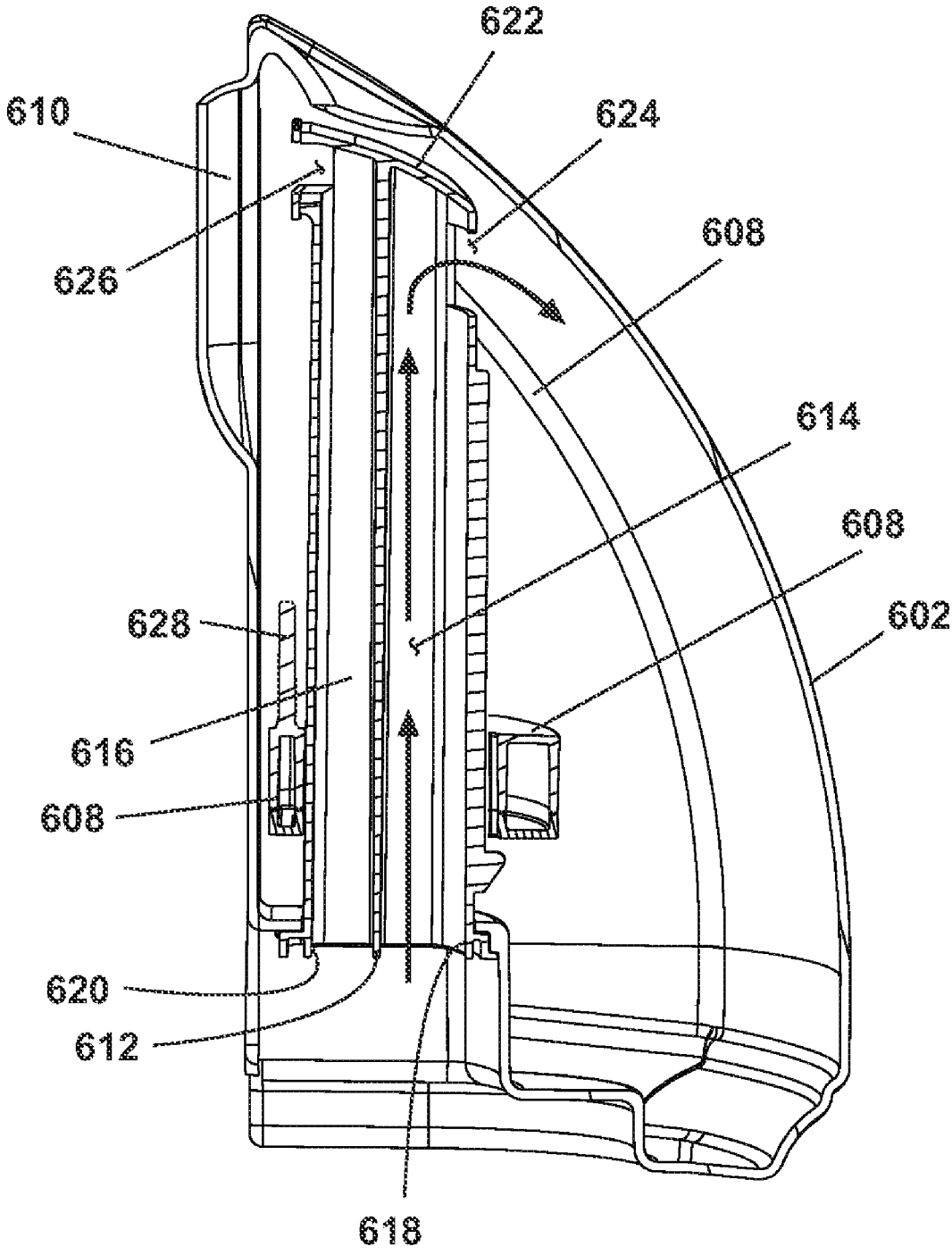
FIG. 13 is a sectional view of the recovery tank assembly taken along line 13—13 of FIG. 3, illustrating a shut off plate in an open position.
Figure 14:
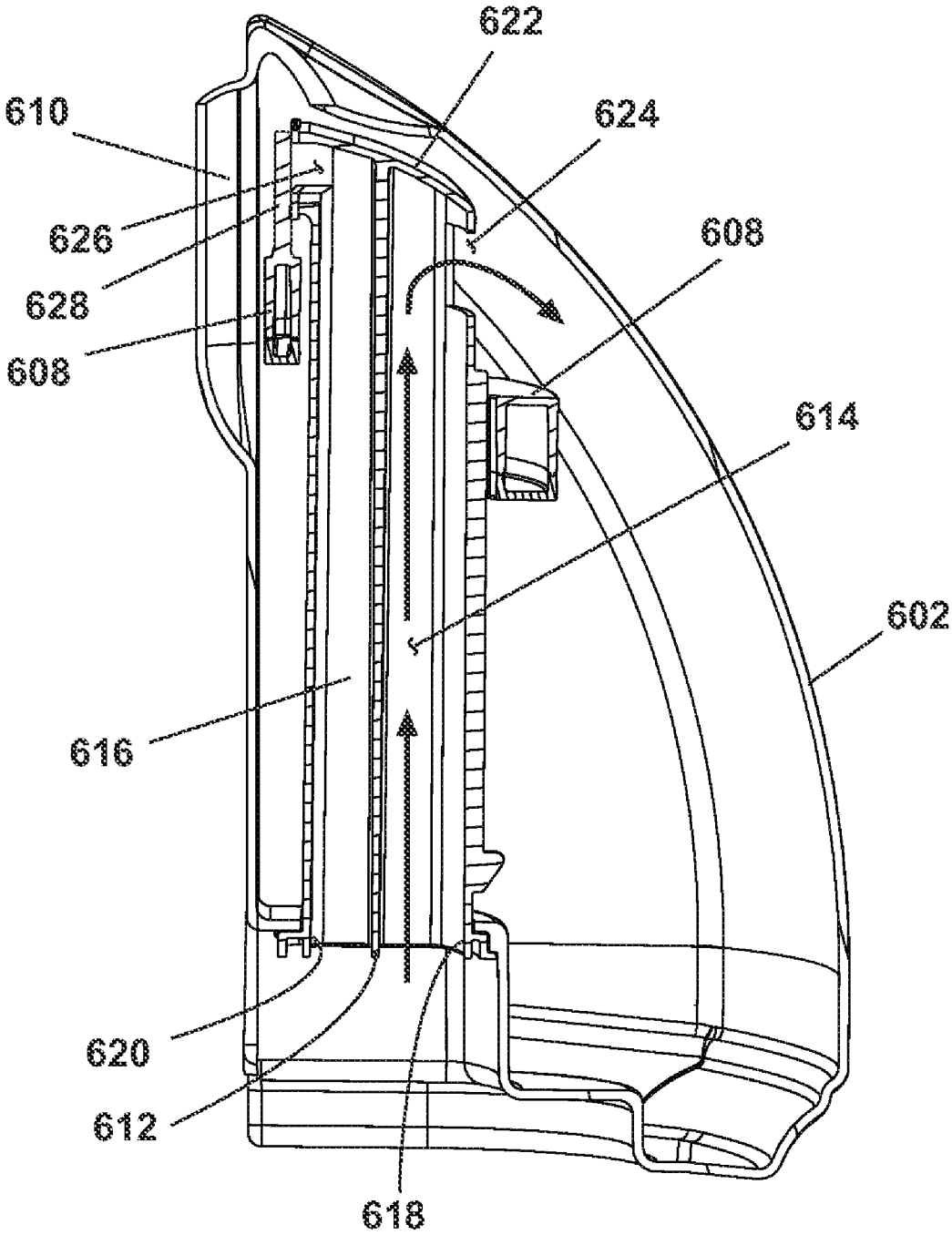
FIG. 14 is a sectional view of the recovery tank assembly taken along line 13—13 of FIG. 3, illustrating a shut off plate in a closed position.

Referring to FIGS. 12–14, the recovery tank assembly 508, which is part of a fluid extraction system, comprises a recovery tank 602 with single aperture 604, a centrally mounted standpipe 606 within the tank 602 and in fluid communication with the aperture 604, and a float 608 slidingly received on the standpipe 606. The recovery tank 602 is preferably blow molded of a transparent or semi-transparent material for visibility of the interior of the recovery tank 602. At least one alignment protrusion 610 on an outer surface of the tank 602 mates with a corresponding recess (not shown) on the top housing 504 to maintain proper alignment of the tank 602 relative to the top housing 504. The standpipe 606 is a generally rectangular tube-like structure comprising an interior wall 612 that divides the interior of the standpipe 606 into two separate air paths: a dirty air path 614 and a clean air path 616. A lower end of the standpipe 606 defines a working air inlet 618 and a clean air outlet 620. An upper end of the standpipe 606 comprises a deflector 622 and a dirty air exhaust aperture 624 formed between a top wall of the standpipe 606 and the deflector 622. A clean air inlet aperture 626 formed in the standpipe 606 on a side opposite the dirty air exhaust aperture 624 is in fluid communication with the clean air path 616. The float 608 comprises a shut off plate 628 that moves between an open position and a closed position to open and close, respectively, the clean air inlet aperture 626. The shut off plate 628 moves from the open position (shown in FIG. 13) to the closed position (shown in FIG. 14) when the debris and fluid in the recovery tank 602 exceeds a predetermined volume, thus drawing the float 608 upward and closing the clean air inlet aperture with the plate 628.

As in the BISSELL Little Green Model 1425 and disclosed in the above referenced Lenkiewicz '891 application, the motor/fan assembly 512 generates working air flow and working/dirty air is drawn through the dirty air path 614 of the standpipe 606 via the working air inlet 618. The dirty air is drawn through the dirty air path 614 and impacts the deflector 622. Upon impact, the working air changes direction and slows, and the heavier dirt and liquid particles separate from the working air and fall to the bottom of the recovery tank 602. Lighter, clean air is thereafter drawn over the top of the deflector 622 and enters the clean air path 616 via the clean air inlet aperture 626 in the standpipe 606. The clean air travels down the clean air path 616 and through the clean air outlet 620 and is drawn into an inlet on the motor/fan assembly 512.

Figure 15:
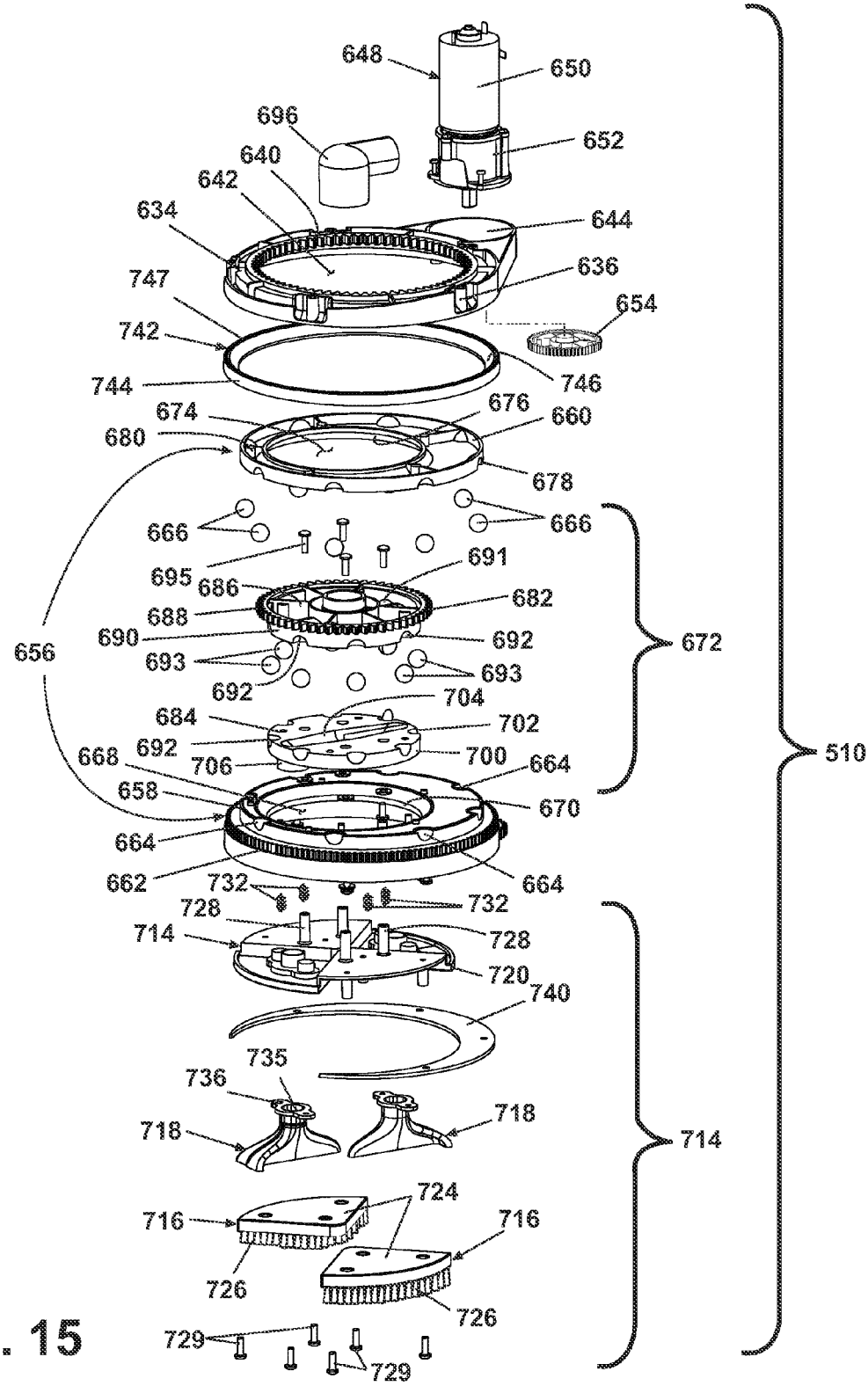
FIG. 15 is an exploded view of the carriage assembly shown in FIG. 3.
Figure 16:
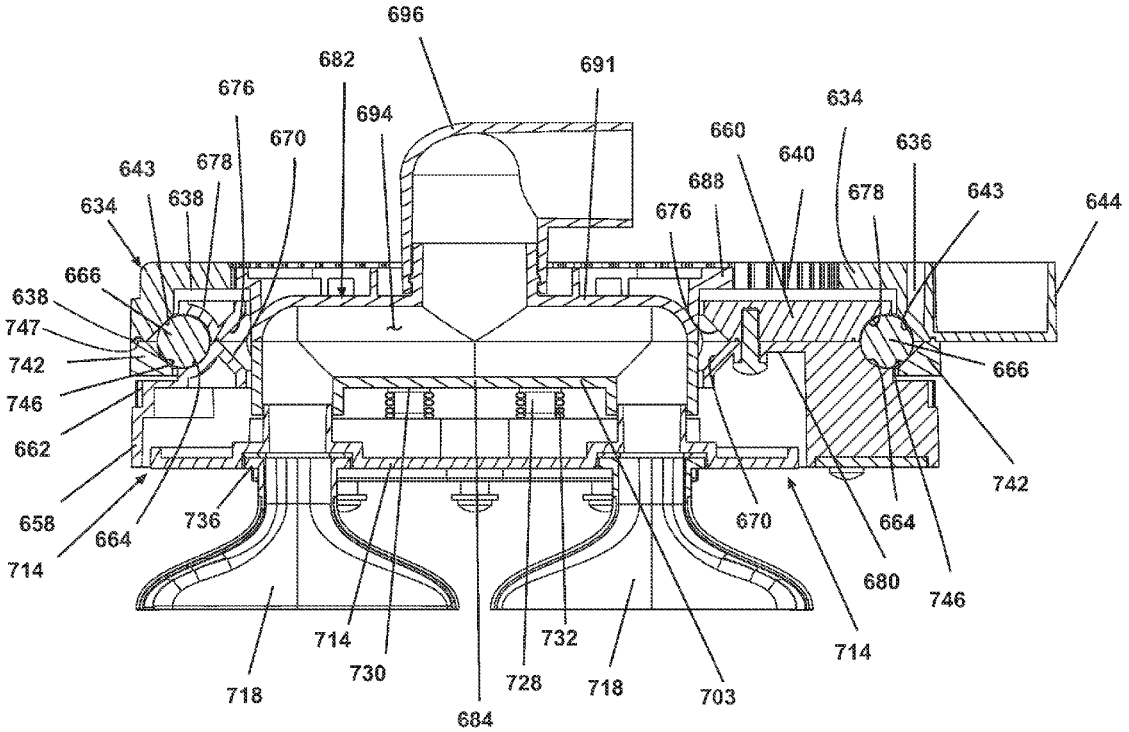
FIG. 16 is a sectional view of the carriage assembly taken along line 16—16 of FIG. 19.
Figure 17:
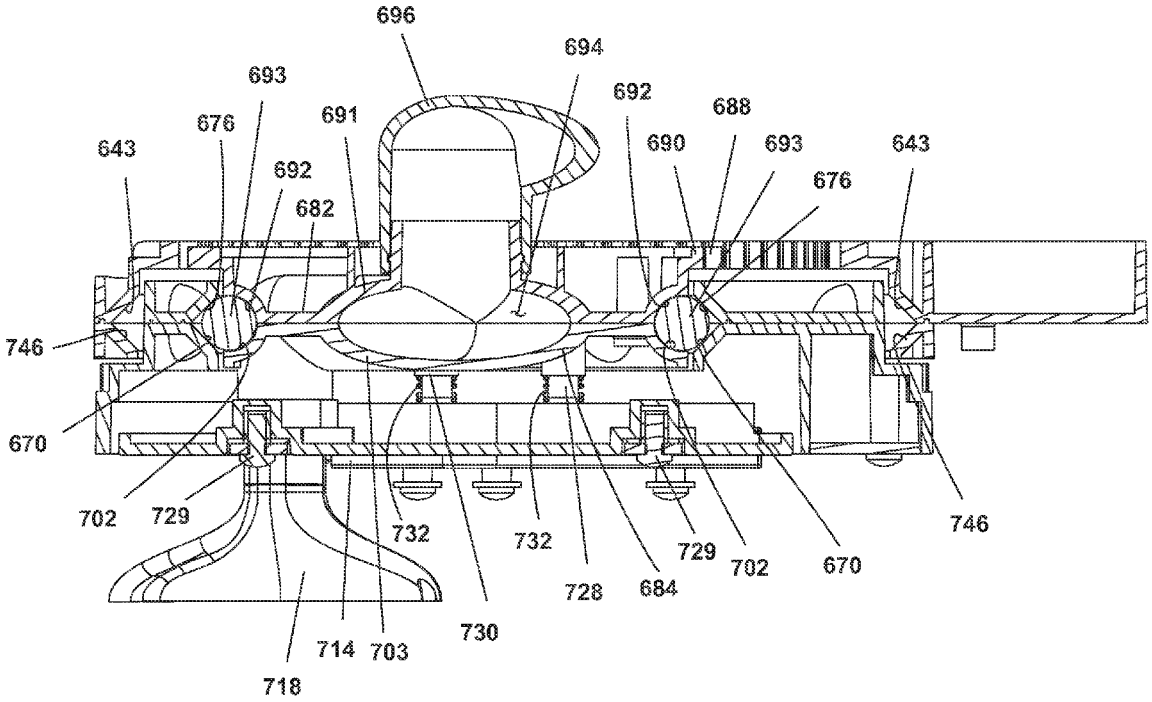
FIG. 17 is a sectional view of the carriage assembly taken along line 17—17 of FIG. 19.

Referring to FIGS. 15–17, the carriage assembly 510 comprises a plurality of agitation assemblies 716 and suction nozzle assemblies 718. The carriage assembly 510 moves the agitation and suction nozzle assemblies 716, 718 through an orbital path to scrub the surface to be cleaned and suction excess liquid therefrom. A circular main ring gear 634 is rigidly attached to a bottom surface of a carriage assembly support 554 (FIG. 4) on the bottom housing 502 by a plurality of screws that pass through circumferentially disposed screw bosses 636. A recess 638 is formed around the perimeter in a bottom surface of the main ring gear 634. A plurality of ring gear teeth 640 formed on an inner perimeter defines a ring gear aperture 642. A chamfer generally extending from inboard the recess 638 to outboard the gear teeth 640 forms an upper race 643 of a bearing to be more fully described below. A cup-shaped gear motor well 644 with a corresponding gear motor aperture (not shown) formed through a bottom surface thereof extends tangentially from an outer perimeter of the ring gear 634. A commonly known gear box assembly 648 comprising a gear motor 650 and a planetary gear box assembly 652 are supported within the gear motor well 644. A motor pinion gear 654 is keyed to an output shaft on the planetary gear box assembly 652. In an alternate embodiment, the motor pinion gear 654 can be driven by a mechanical crank powered by the user.

A drive plate assembly 656 comprises a bottom drive gear 658 and a top drive plate 660. The bottom drive gear 658 comprises a plurality of drive gear teeth 662 on an outer perimeter that mesh with corresponding teeth on the motor pinion gear 654. A plurality of ball bearing sockets 664 are located inboard of the drive gear teeth 662 and house corresponding ball bearings 666. A pinion gear aperture 668 is formed in an eccentric manner on an inner perimeter of the bottom drive gear 658. A chamfer at an outer perimeter of the pinion gear aperture 668 serves as a race 670 for a corresponding pinion gear assembly 672, which will be further described hereinafter.

The top drive plate 660 is a generally plate like disc with a top pinion gear aperture 674 formed therethrough. A chamfer at an outer perimeter of the top pinion gear aperture 674 serves as an upper race 676 for the pinion gear assembly 672. A plurality of ball bearing sockets 678 are located on an outer perimeter of the top drive plate 660 and correspond with the ball bearing sockets 664 on the bottom drive gear 658. A plurality of screw bosses 680 provide locations for screws that secure the bottom drive gear 658 to the top drive plate 660.

The pinion gear assembly 672 comprises an upper pinion gear 682 and a lower pinion plate 684. The upper pinion gear 682 is a circular pan-like structure with stiffening ribs 686 radiating from a central hub to an outer perimeter. A plurality of gear teeth 688 formed along an outer perimeter of the upper pinion gear 682 mesh with the corresponding ring gear teeth 640. An outer perimeter wall 690 comprises a plurality of ball bearing sockets 692 similar to those previously described on the bottom drive gear 658 and the top drive plate 660. Ball bearings 693 similar to the ball bearings 666 reside partially within the ball bearing sockets 692. The upper pinion gear 682 includes an arched upper wall 691 that forms an upper portion of a working air plenum 694. The lower portion of the working air plenum 694 is defined by the lower pinion plate 684. A working air swivel fitting 696, which will be described in further detail hereinafter, couples with the upper pinion gear 682 at a top surface thereof for fluid communication with the working air plenum 694. A plurality of apertures (not shown) extend through the upper pinion gear 682 to receive a corresponding plurality of screws 695 to secure the upper pinion gear 682 to the lower pinion plate 684.

The lower pinion plate 684 further comprises an outer perimeter wall 700 with a plurality of ball bearing sockets 702 that correspond with the ball bearing sockets 692 on the upper pinion gear 682. An arched lower wall 704 in an upper surface of the lower pinion plate 684 forms the lower portion of the working air plenum 694. Hence, the working air plenum 694 is defined between the upper pinion gear 682 and the lower pinion plate 684. A plurality of apertures on the bottom surface of the lower pinion plate 684 form working air inlets 706 for the working air plenum 694. The lower pinion plate 684 is secured to the upper pinion gear 682 by a plurality of screws 695.

A circular agitation plate assembly 714 mounts the agitation assemblies 716 and suction nozzle assemblies 718 to the carriage assembly 510. The basic structure for the agitation plate assembly 714 is provided by a generally disc shaped agitation support plate 720. Each agitation assembly 716 comprises a housing with a plurality of commonly known brush bristles 726 protruding downwardly therefrom. Alternatively, other agitation devices or scrubbing implements can be used, such as a cloth and foam pads, in place of the bristles 726. Each agitation assembly 716 is fastened to the agitation support plate 720 in a conventional manner with screws 729. A plurality of upwardly protruding bosses 728 on the agitation support plate 720 slidingly engage an inner surface of a plurality of corresponding downwardly protruding screw bosses 730 on the lower pinion plate 684. Coil springs 732 are positioned over the lower pinion plate screw bosses 730 are captured between a lower surface of the lower pinion plate 684 and an upper surface of the agitation support plate 720. The coil springs 732 bias the agitation plate assembly 714 towards the surface to be cleaned to thereby facilitate enhanced agitation of the surface to be cleaned and seal the suction nozzles 734 with the surface to be cleaned. The biasing force is less than the weight of the housings 502, 504. In addition, the springs 732 absorb shock to minimize vibration of the carriage assembly 510. Reduced vibration results in a lower tendency for the unattended cleaner 500 to move or undesirably migrate during operation.

A crescent shaped cover plate 740 mates with a bottom surface of the bottom drive gear 658 to prevent debris from entering the bearing surfaces previously described. The cover plate 740 is essentially coplanar with the agitation support plate 720.

The carriage assembly 510 further comprises a retainer ring 742 that snaps into the recess 638 on the lower surface of the main ring gear 634. The retainer ring 742 comprises a generally vertical outer perimeter wall 744 and a downwardly sloping chamfer on an inner surface to form a bottom race 746 of an outer bearing surface formed between the main ring gear 634 and the bottom drive gear 658.

Figure 18:
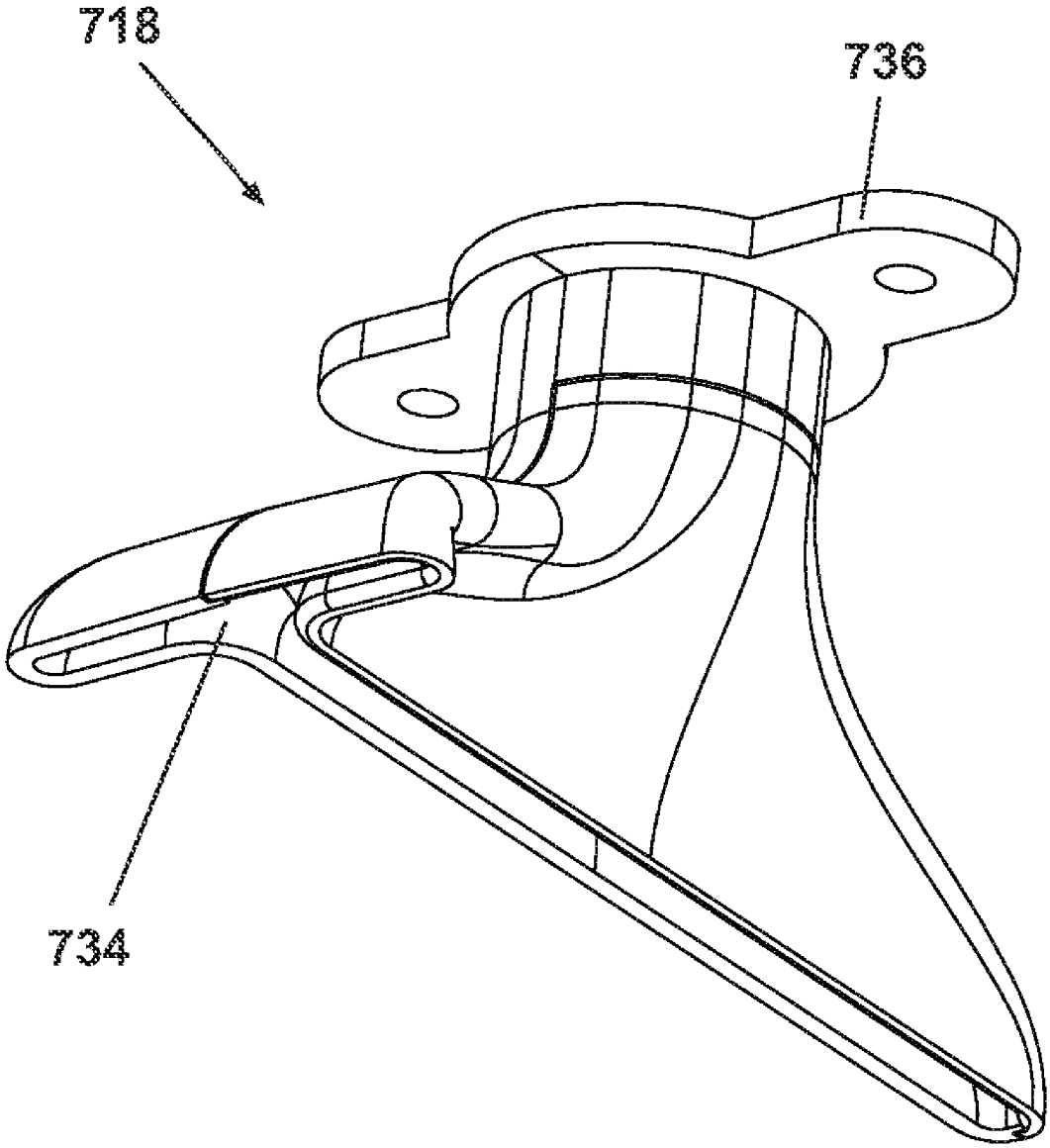
FIG. 18 is a perspective view of a suction nozzle for the carriage assembly shown in FIG. 15.

Referring to FIG. 18, the suction nozzle assemblies 718 are shaped so as to maximize the coverage thereof over the surface to be cleaned when moving in an orbital path. A suction nozzle 734 forms a generally "T" shape at the surface to be cleaned. Alternative geometries for the suction nozzle 734 include narrow rectangular, oval, and "L" shaped openings. A working air conduit is formed through the interior of the suction nozzle assembly 718 and terminating in a working air outlet 735 (FIG. 16) at an end opposite the suction nozzle 734. A suction nozzle flange 736 surrounds around the working air outlet 736 and provides an interface to sealingly couple the suction nozzle assembly 718 to the agitation support plate 720.

The carriage assembly 510 is assembled by attaching the suction nozzle assemblies 718 and agitation assemblies 716 to the agitation support plate 720. The agitation support plate 720 is mounted to the upper pinion gear 682 by screws that pass through the lower pinion plate 684. Before the agitation support plate 720 is fixed to the upper pinion gear 682, the ball bearings 693 are positioned in the corresponding ball bearing sockets 692 so that they are captured between the upper pinion gear 682 and the lower pinion plate 684. This assembly is mated with the bottom drive plate 658 so that the ball bearings 693 rest on the bottom drive gear race 670. The top drive plate 660 is assembled to the bottom drive plate 658 with the drive bear ball bearings 666 located in the corresponding ball bearing sockets 664. The retainer ring 742 is placed on the bottom drive gear 658 so that the ball bearings rest on the retainer ring race 746. The partially assembled structure is raised into position with the main ring gear race 643 so that the ball bearings 666 on the retainer ring race 746 contact the main ring gear race 643. A flange 747 on an upper surface of the retainer ring 742 is press fit to engage the recess 638 on the lower surface of the main ring gear 634 to lock the drive plate assembly 656 to the main ring gear 634.

Figure 19:
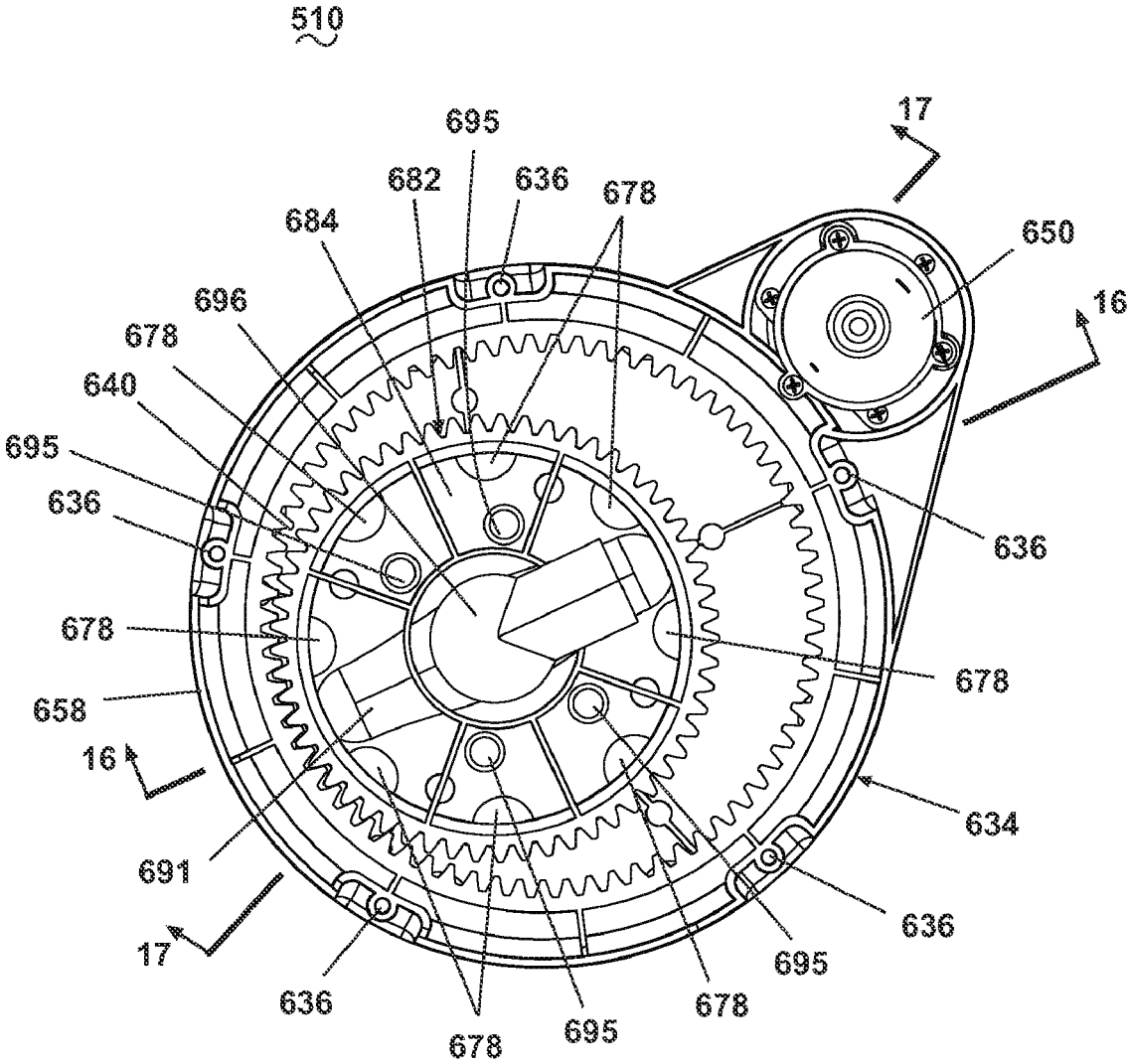
FIG. 19 is a top plan view of the carriage assembly shown in FIG. 3.
Figure 20:
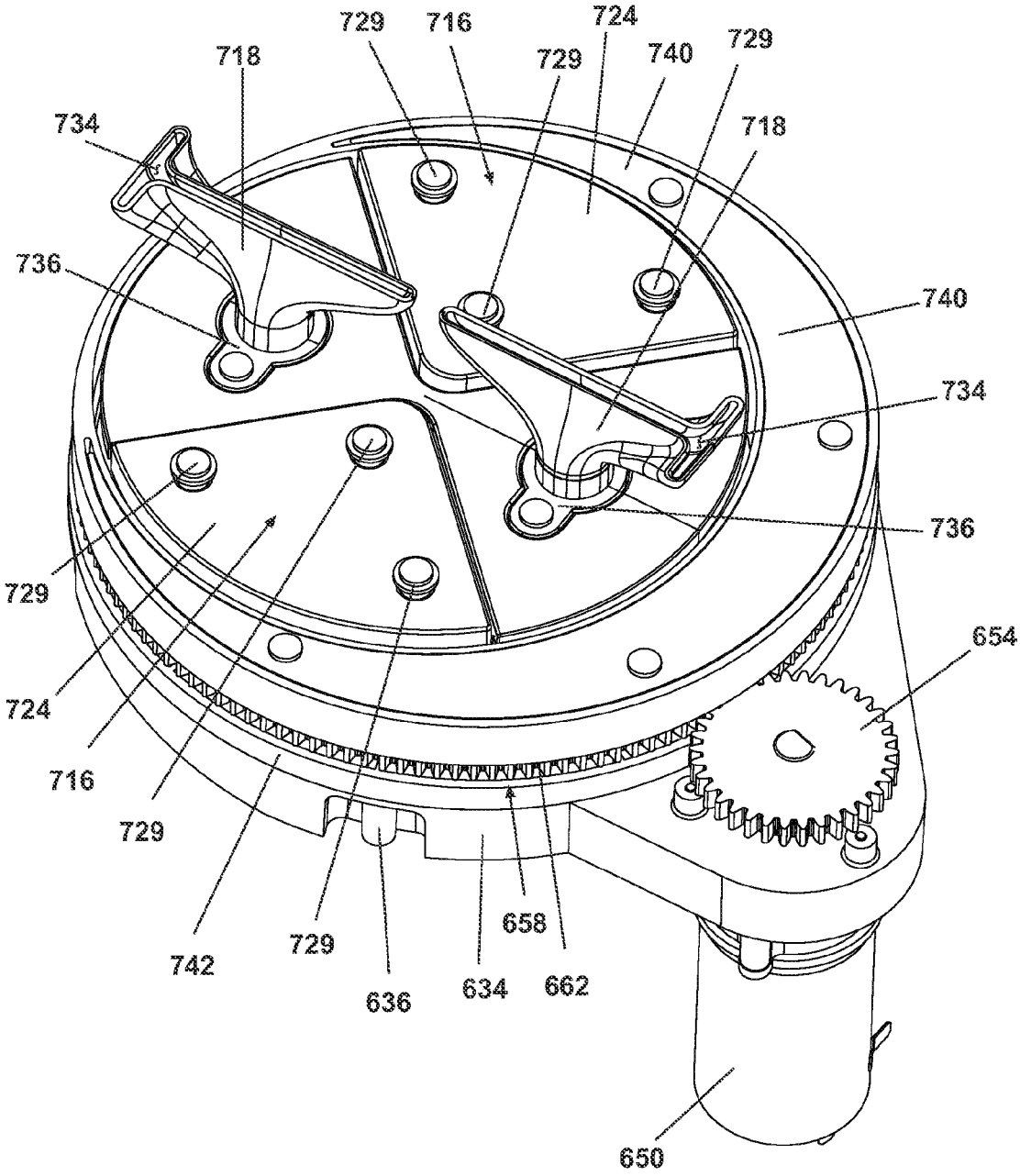
FIG. 20 is a bottom perspective view of the carriage assembly shown in FIG. 3.

Operation of the carriage assembly 510 is herein described with reference to FIGS. 19 and 20. When power is supplied to the gear motor 650, the shaft rotates and induces rotation of the motor pinion gear 654. The teeth of the motor pinion gear 654 mesh with the bottom drive gear teeth 662, thereby causing the bottom drive gear 658 to rotate about its centerline. As the bottom drive gear 658 rotates, the pinion gear assembly 672 rotates in an opposite direction about its centerline. Since the pinion gear aperture 668 is off center relative to the centerline of the bottom drive gear 658, the pinion gear assembly 672 and, thus, agitator plate assembly 714, the agitation assemblies 716, and the suction nozzle assemblies 718, move in an orbital motion. In other words, the pinion gear assembly 672 rotates about its own centerline while orbiting about the centerline of the bottom drive gear 658. The agitation assemblies 716 and the suction nozzle assemblies 718, therefore, move laterally relative to the surface to be cleaned and relative to the bottom housing 502, which remains stationary. The counter-rotational movement of the pinion gear assembly 672 is caused by a cam action, since the pinion gear assembly 672 is captured within the drive plate assembly 656 in an offset position. Because the gear teeth 688 on the upper pinion gear 682 engage with the fixed teeth 640 on the main ring gear 634, the rotation of the pinion gear assembly 672 is generated independent of the rotation of the drive plate assembly 656. The orbital motion ensures that all of the area under the carriage assembly support 554 is cleaned. Alternatively, the agitator plate assembly 714 can be aligned with the centerline of the bottom drive gear 658 so that the agitator plate assembly 714 rotates in a simple circular manner about a single axis. However, the orbital motion is preferred because the agitator assemblies 716 can completely cover the area under the agitator plate assembly 714 and cleans the center of the axis of rotation as well as the outer periphery of the agitator assemblies 716 and suction nozzle assemblies 718.

In the preferred embodiment, the gear motor 650 is controlled by the controller 106, which includes a pair of relays controlled by a timer. Closing either relay completes an electrical circuit and energizes the motor 650. When the first relay is closed, the motor rotates in a first direction corresponding to a first driving direction of the agitator plate assembly 714. Switching between the relays reverses the polarity of the motor, such that the motor rotates in a second direction that is opposite the first direction and corresponds to a second driving direction of the agitator plate assembly 714. For exemplary purposes, the first driving direction of the agitator plate assembly 714 can generally be clockwise when view from a top orientation, and thus the second driving direction can generally be counterclockwise. When both relays are open, the electrical circuit to the motor 650 is open and the motor 650 is de-energized. The timer controls the opening and closing of the relays, such that the relays are switched after a predetermined time period. For example, the relays can be switched every 30 seconds, reversing the polarity of the motor, thus reversing the motor direction. In this way, the agitator plate assembly 714 can be controlled to rotate in one direction and then reverse direction so that the bristles contact an opposite side of the carpet fiber resulting in improved cleaning performance. Furthermore, the controller 106 can switch the relays once more for five seconds at the end of the duty cycle to straighten or "fluff up" any carpet fibers that may be flattened during agitation after the cleaning is complete.

Figure 21:
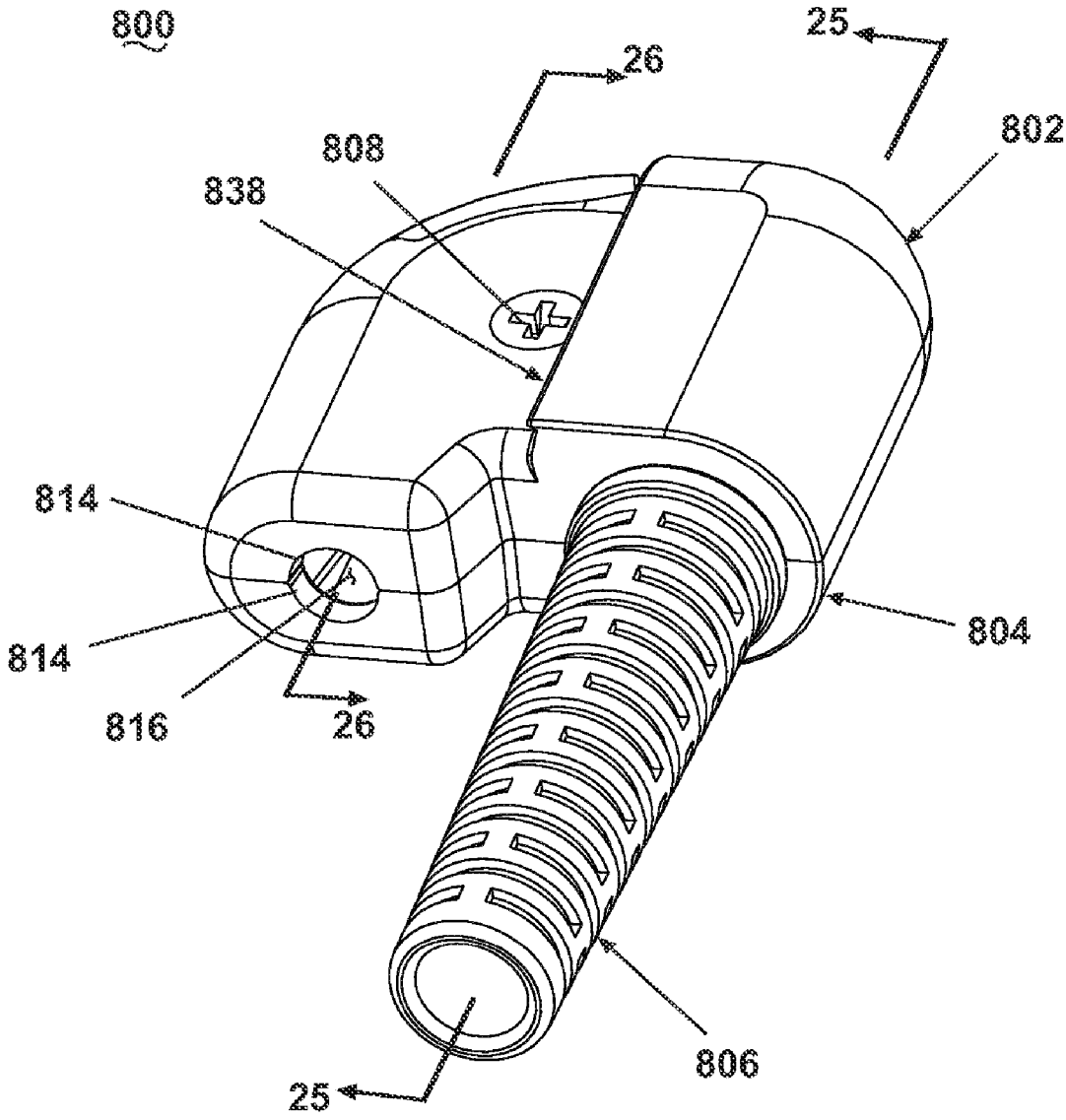
FIG. 21 is a perspective view of a modular strain relief assembly of the unattended spot cleaning apparatus shown in FIG. 1.
Figure 22:
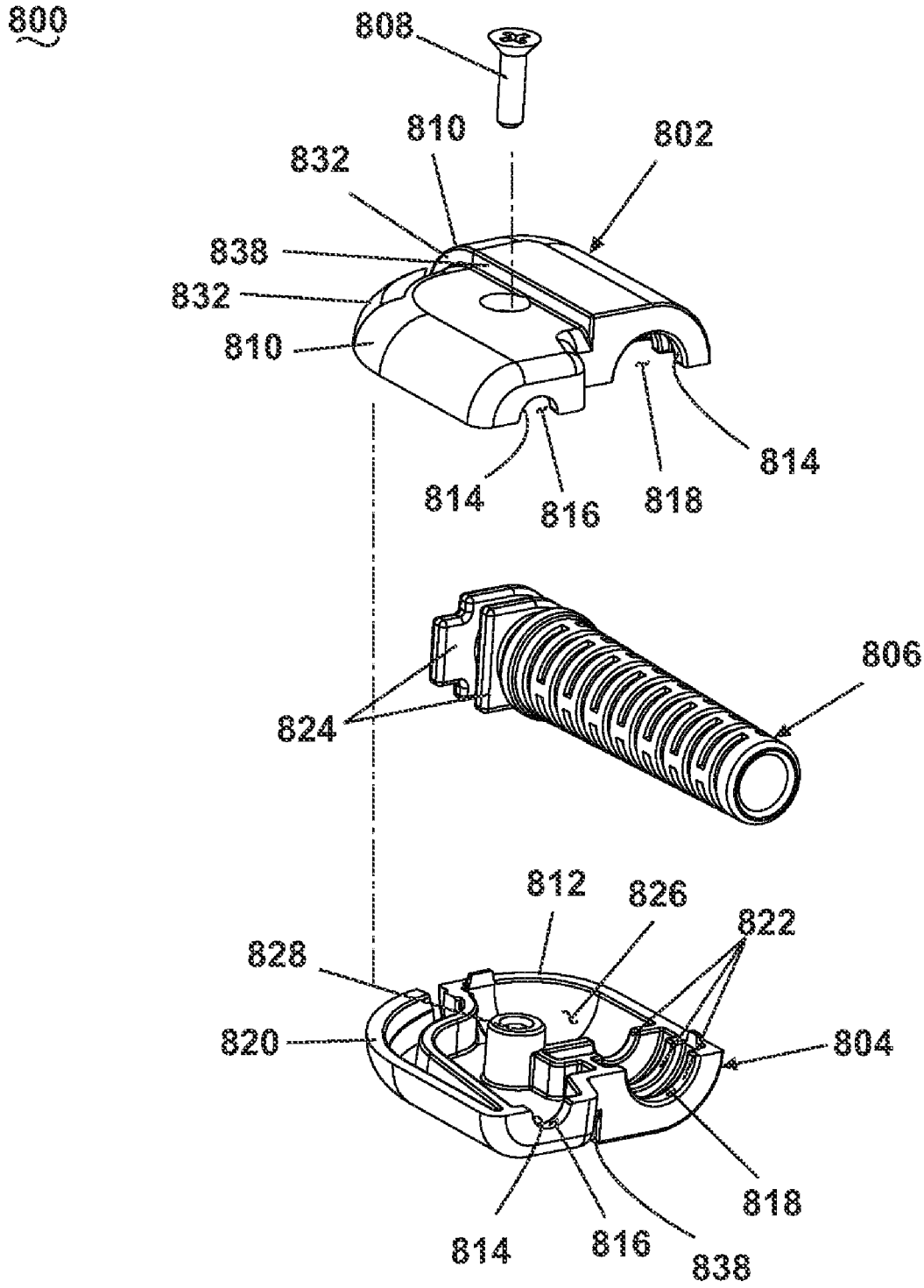
FIG. 22 is an exploded view of the modular strain relief assembly shown in FIG. 21.
Figure 23:
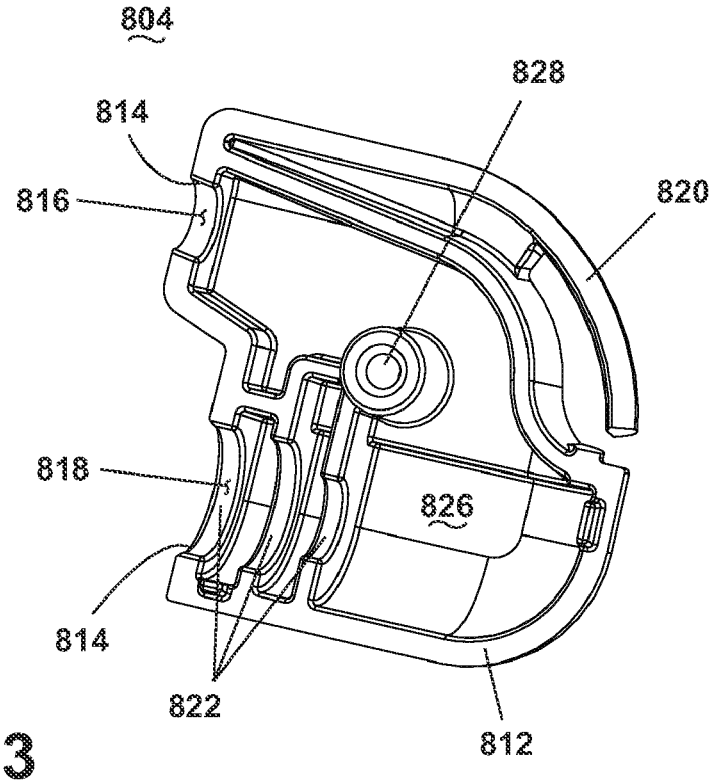
FIG. 23 is a perspective view of a lower housing of the strain relief assembly shown in FIG. 22.
Figure 24:
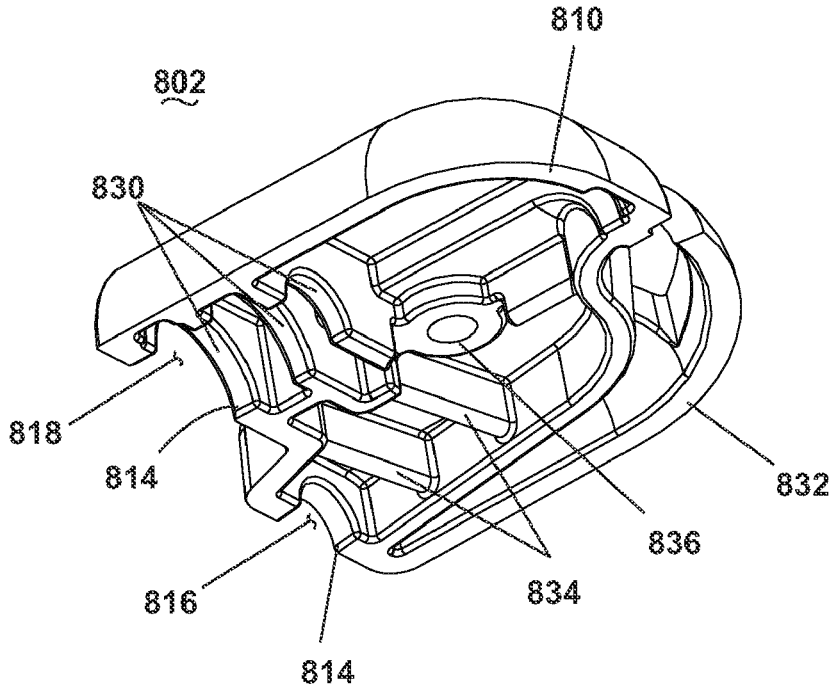
FIG. 24 is a perspective view of an upper housing of the strain relief assembly shown in FIG. 22.
Figure 25:
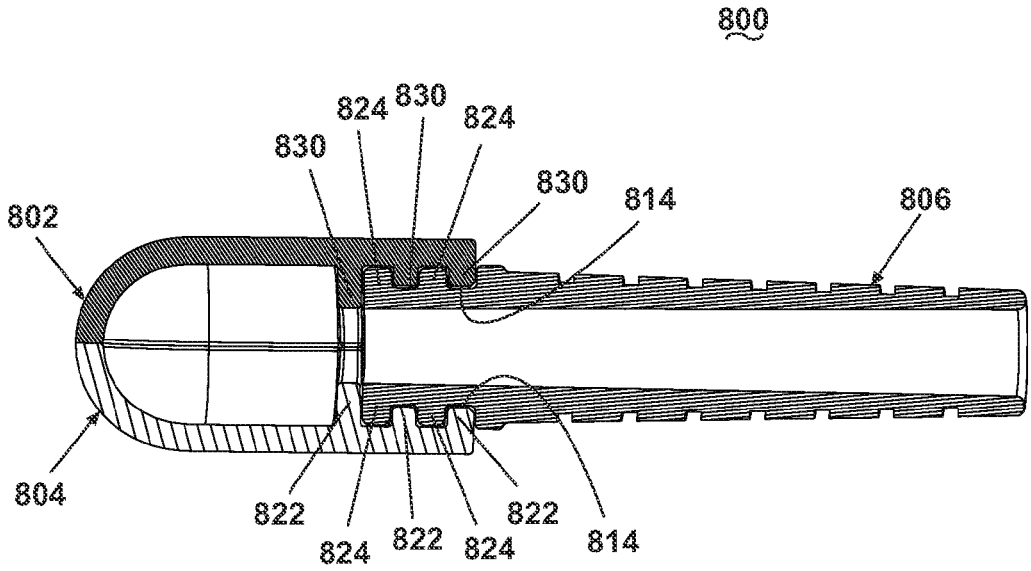
FIG. 25 is a section view of the strain relief assembly taken along line 25—25 of FIG. 21.
Figure 26:
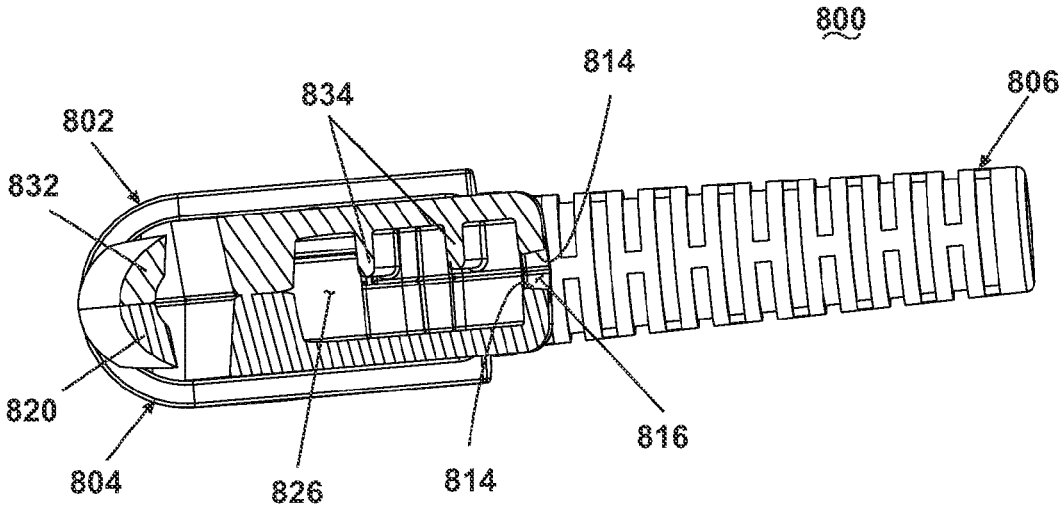
FIG. 26 is a section view of the strain relief assembly taken along line 26—26 of FIG. 21.

Referring to FIGS. 21 and 22, the modular strain relief assembly 800 further comprises an upper housing 802, a lower housing 804, a commonly known bend relief device 806 that prevents outer jacket of the power cord from excessive bend radii, and a commonly known screw 808 or other suitable fastening device. The assembled modular strain relief assembly 800 forms a passage in which the power cord is securely retained. Both the upper housing 802 and lower housing 804 comprise an outer wall 810 and 812, respectively that forms the basic structure for the enclosure. Both the upper housing 802 and lower housing 804 further comprise a pair of semi-circular arcuate cut-outs 814 sized and positioned such that when the housings 802, 804 are mated, the cut-outs form a generally circular aperture 16 therethrough. One aperture 816 is sized to allow the power cord to pass while the other aperture 818 is sized to receive the bend relief 806.

Referring to FIGS. 22–26, the lower housing 804 further comprises a resilient lower tab 820 that joins the outer wall 812 at one end and is unattached at the other end and is laterally displaceable when exposed to an external force. A plurality of bend relief retaining walls 822 formed near the bend relief aperture 818 engage with a corresponding set of retaining walls 824 formed in one end of the bend relief 806. A generally U-shaped power cord passage 826 is formed on an interior of the lower housing 804 around a generally centrally located integrally formed screw boss 828. The upper housing 802 also has a plurality of bend relief retaining walls 830 that correspond with the retaining walls 822 on the lower housing 804 so that, when assembled, effectively secure the bend relief 806 with the assembled housings 802, 804. The upper housing 802 also incorporates a resilient tab 832 that mirrors the lower housing 804 resilient tab 820 and is capable of flexing in a similar manner. Unlike the lower housing 804, however, the upper housing 802 further comprises a plurality of strain relief ribs 834 that depend orthogonally from an inner surface of the outer wall 810 into the passage 826, near the power cord aperture 816 formed by the corresponding cut-outs 814. The strain relief ribs 834 are sized to make an interference contact with the outer jacket of the power cord to effectively retain the cord in the strain relief assembly 800 but not so far that they apply excessive pressure to the inner conductors contained within the outer jacket. Excessive pressure on the inner conductors can cause cold flow of the insulators, resulting in undesirable direct contact of the internal conductors. A screw aperture 836 is formed though the outer wall 810 and is in axial alignment with the corresponding screw boss 828 integrally formed in the lower housing 804.

To assemble the modular strain relief assembly 800, the bend relief 806 is slipped over the outer jacket of the power cord. The power cord and bend relief 806 are laid in the lower housing 804 so that the bend relief retaining walls 824 engage with the lower housing bend relief walls 822. The power cord is routed around the screw boss 828 and exits the lower housing at the power cord aperture 816 formed by the cut-out 814. The upper housing 802 is placed over the lower housing 804 so that the outer walls (810, 812), resilient tabs (820, 832) screw aperture 836, and screw boss 828 are in alignment. The screw 808 is inserted through the screw aperture 836, is captured by the screw boss 828, and is tightened such that the strain relief ribs 834 make an interference contact with the power cord outer jacket.

Figure 27:
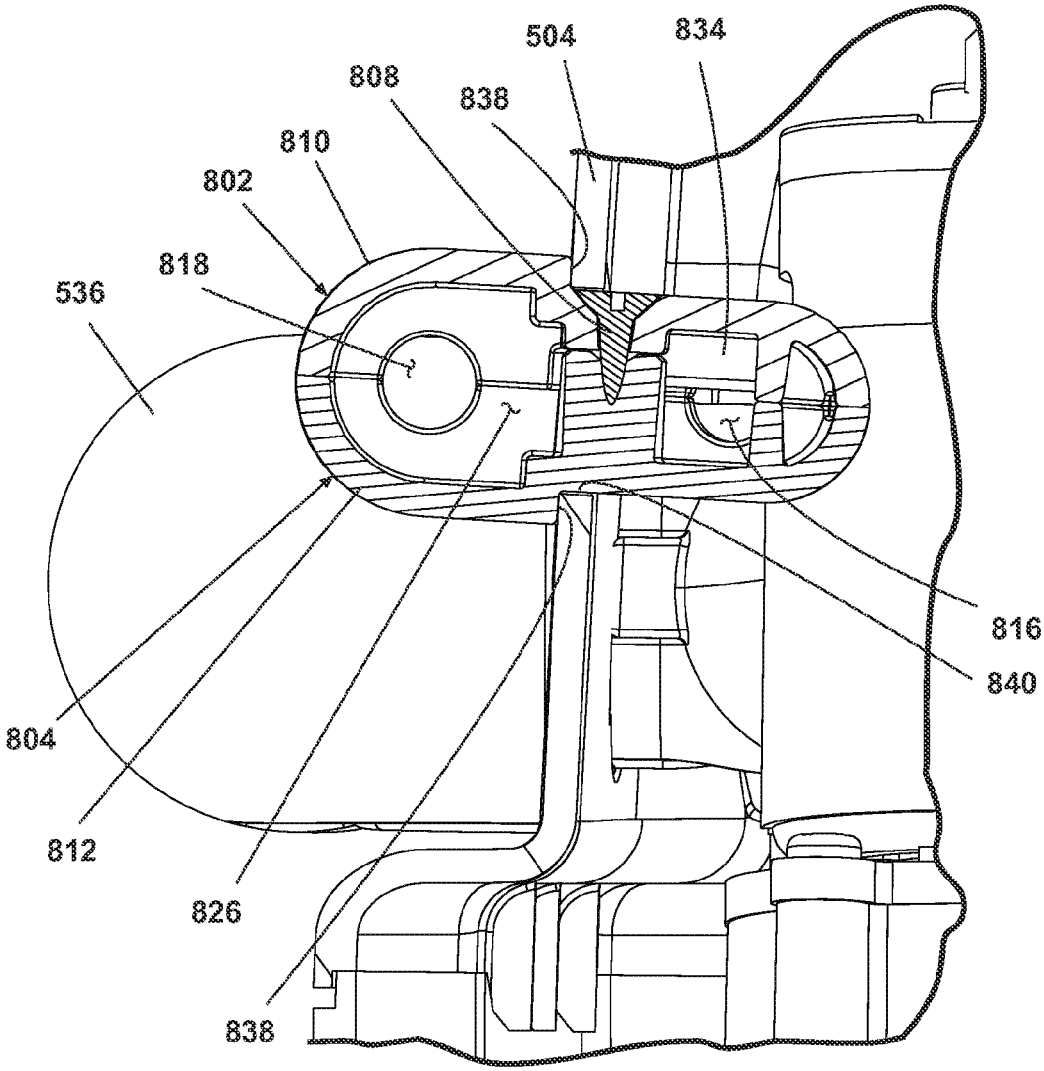
FIG. 27 is a section view of the strain relief assembly installed in the unattended spot cleaning apparatus taken along line 27—27 of FIG. 1.

Referring to FIGS. 21 and 27, the assembled modular strain relief assembly 800 forms a seating surface 838 comprising a rib-like structure on each of the housings 802, 804 that mates with the outer surface of the top housing 504. An aperture 840 of suitable size is formed through the top housing 504 to receive the strain relief assembly. To assemble the modular strain relief to the top housing 504, the free end of the power cord is inserted through an aperture 840 in the top housing 504. The power cord aperture 816 is also inserted into the housing aperture 840 and positioned such that the wall of the housing aperture is in contact with the strain relief outer walls (810, 812). The strain relief assembly 800 is then rotated about this point so that the resilient tabs (820, 832) are forced past an opposite side of the aperture 840, displacing the tabs (820, 832) so that they pass through the aperture 840. Once the tabs (820, 832) pass the aperture 840 wall, the tabs (820, 832) return to their previous position thus locking the modular strain relief assembly to the top housing 504 as shown in FIG. 27.

The installed modular strain relief assembly 800 serves to secure the power cord to the housing 504 in a manner that relieves strain on the internal connections within the housing 504 by virtue of the tortuous U-shaped path and the engagement of the strain relief ribs 834 with the power cord outer jacket. In addition, the bend relief 806 limits the bend radius of the out jacket at the exit of the top housing 504 to minimize fatigue failures in this area. Alternatively, any conventional strain relief device can be used to secure the power cord to the housing.

Figure 28:
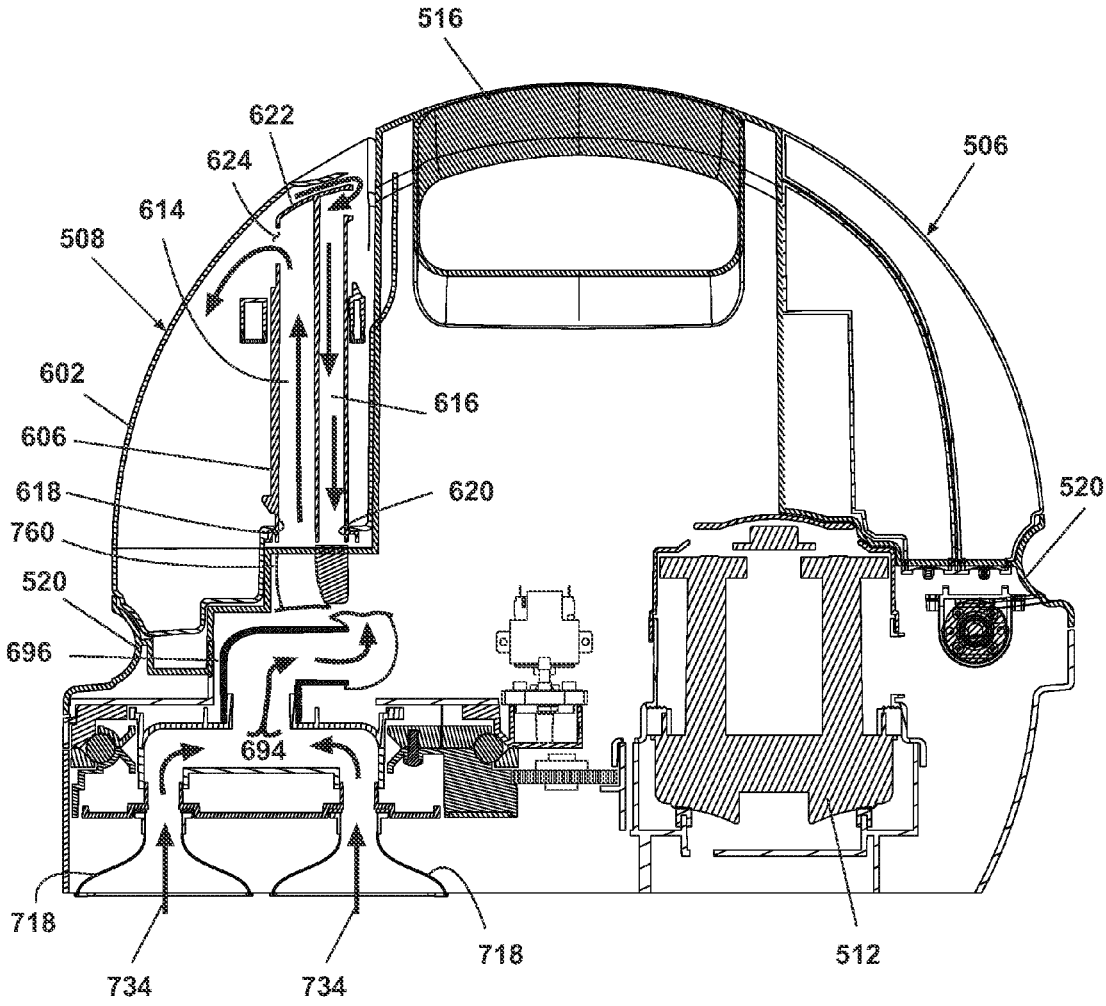
FIG. 28 is a sectional view of the unattended spot cleaning apparatus taken along line 28—28 of the FIG. 2.
Figure 29:
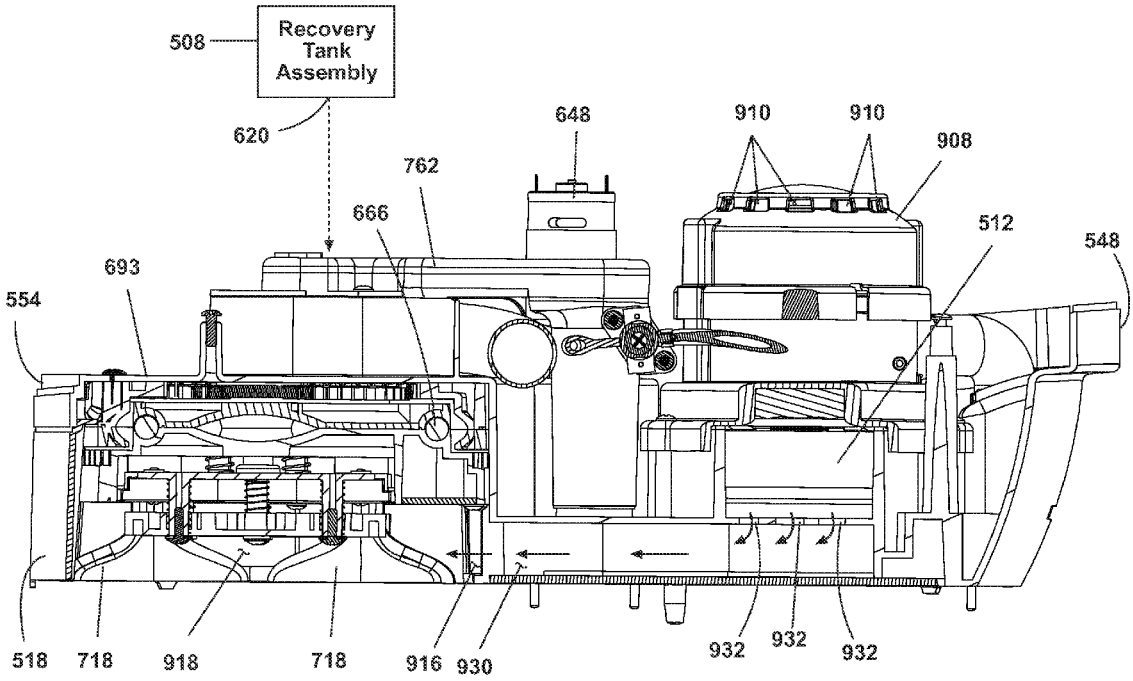
FIG. 29 is a sectional view of the bottom housing of the unattended spot cleaning apparatus taken along line 29—29 of FIG. 4.
Figure 30:
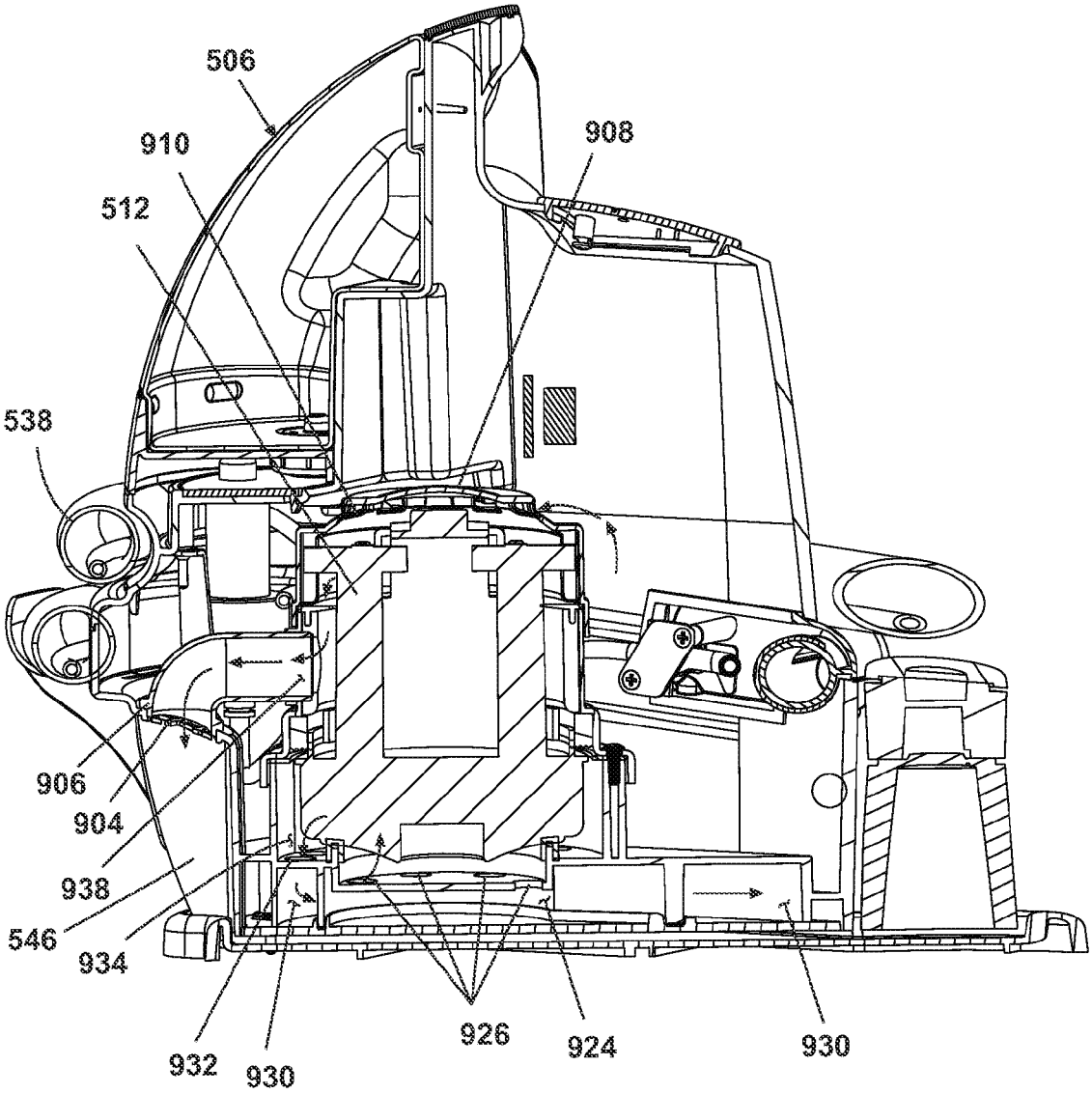
FIG. 30 is a section view of the bottom housing of the unattended spot cleaning apparatus taken along line 30—30 of FIG. 1.

The working air path of the spot cleaning apparatus 500 is illustrated in FIGS. 28–30, as indicated by arrows. Referring to FIG. 28, in an automatic or unattended mode of operation, the working air generated by the motor/fan assembly 512 is drawn from the surface to be cleaned through the suction nozzles 734, through the working air outlets 735 of the suction nozzle assemblies 718, into the working air plenum 694 defined between the upper pinion gear 682 and the lower pinion plate 684, and up through the swivel fitting 696. The working air flows through a flexible hose (not shown) connected to the swivel fitting 696 on one end and the suction hose fitting 536 on the other end. The working air flows through the suction hose 538 to the suction hose grip 540 and grip support fitting 544 to a fixed working air conduit 760 positioned within the bottom housing 502. When the spot cleaning apparatus 500 is being used in the manual mode, the user removes the suction hose grip 540 from the grip support fitting 544 and maneuvers the suction hose grip 540 and any tools attached thereto over the surface to be cleaned in a conventional manner. Removal of the suction hose grip 540 from the grip support fitting 544 disconnects the suction nozzle assemblies from the working air path so that not suction in created at the suction nozzles 734. The fixed working air conduit 760 is coupled with the working air inlet 618 on the standpipe 606 in the recovery tank 602. The working air moves up through the dirty air path 614, impacts the deflector 622, and exits the standpipe 606 through the dirty air exhaust aperture 624 where solid debris falls from the air and settles under force of gravity to the bottom of the recovery tank 602. The clean air is then drawn into the clear air inlet aperture 626, down the clean air path 616 of the standpipe 606, out the clean air outlet 620.

Referring to FIGS. 29 and 30, working air exits the clean air outlet 620 and enters a clean air conduit 762. The working air flow through the clean air conduit 762 through the working air inlet channel 924 and into the motor/fan assembly 512, through the plurality of working air inlet apertures 926. Working air is exhausted from the motor/fan assembly 512 and into a working air exhaust plenum 934 formed between an outer surface of the motor/fan assembly 512 and an inner surface of the side wall 546. Working air is forced through the working air outlet apertures 932, into the working air exhaust channel 930, through the working air return aperture 916 and into the cleaning plenum 918 where it can again be extracted into the suction nozzle 734 to repeat the cleaning cycle. Thus, during operation of the spot cleaning apparatus 500, the exhaust air is continuously re-circulated. This structure provides for adequate working air flow through the bottom housing 502 even though the carriage assembly lens 518 is in sealing contact with the surface to be cleaned.

Referring to FIG. 28, motor cooling air is drawn in from the atmosphere through the motor cooling inlet apertures 902 (FIG. 4) and into a cooling air plenum 936 formed between an inner surface of the side wall 546, an inner surface of the top housing 504, and an outer surface of the motor cover 908. Cooling air is drawn into and passes over the motor/fan assembly 512 to extract heat away from the motor/fan assembly 240. Cooling air is forced through the motor cover exhaust aperture 938, through the cooling air exhaust duct 906, and through the cooling outlet 904 to the atmosphere.

The unattended cleaning apparatus 500 can be operated as an unattended spot cleaner, a manual spot cleaner, and optionally as a portable room air cleaner. To prepare the spot cleaning apparatus for use as the unattended spot cleaner or the manual spot cleaner, a pre-filled clean tank assembly 506 is placed on the top housing 504 above the pump assembly 514. When the clean tank assembly 506 is mounted onto the top housing 504, the umbrella valves 592 automatically open for fluid flow. The user positions the unattended cleaning apparatus 500 over the spot to be cleaned so that the agitation plate assembly 714 is centered over the spot. The user plugs the power cord into a convenient receptacle and selects a desired duty cycle by pressing one of the switches 539, 541, or 543 located on the top housing 504, which thereby powers the controller 106.

Figure 31:
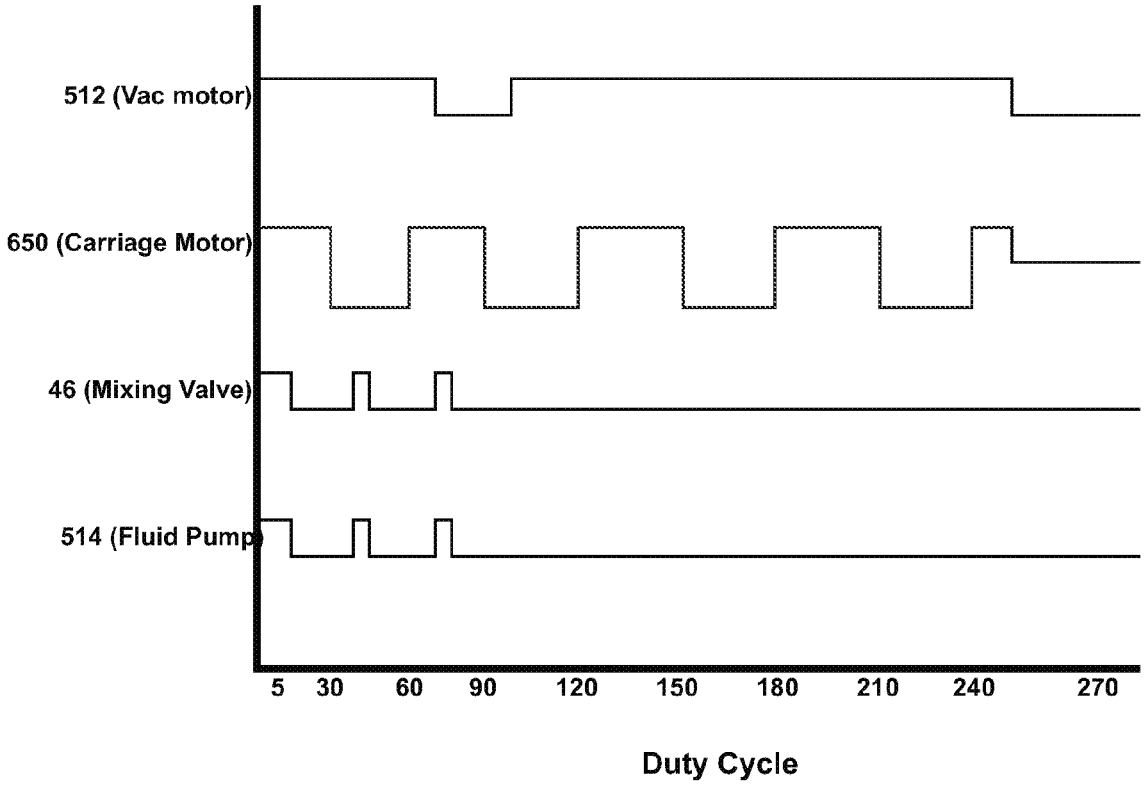
FIG. 31 is an exemplary graph of dwell time for powered components of the unattended spot cleaning apparatus.

A graph depicting dwell time for powered components of the unattended spot cleaning apparatus 500 during an exemplary light duty cycle is presented as FIG. 31. During the light duty cycle, fluid can be delivered in three separate applications while simultaneously extracting spent fluid for approximately 60 and 90 second suction intervals. Preferably, one half of the available fluid is dispersed immediately upon activation of the spot cleaning apparatus 500, followed by two additional fluid applications cycles, wherein each additional fluid application cycle delivers approximately one quarter of the initial volume. Preferably, the cleaning fluid is delivered at a flow rate of 1000 mL/minute. As schematically indicated by the dwell time in FIG. 31 for the mixing valve 46, if utilized, and the fluid pump assembly 514, the preferred fluid delivery cycle comprises 4.5 seconds on, 25.5 seconds off, 2.25 seconds on, 27.75 seconds off, and a final 2.25 seconds on. The gear motor 650 runs constantly throughout the light duty cycle to constantly move the agitation plate assembly 714. As described above, the gear motor 650 can be controlled to switch rotational direction to alternate the rotational direction of the agitation plate assembly 714, for example, every 30 seconds and to switch one more for 5 seconds at the end of the cycle to "fluff up" the carpet. Suction remains active except for 30 seconds between the 60 second and 90 second intervals. The total duration of the light duty cycle is approximately 4 minutes. An exemplary heavy duty cycle completes two of the aforementioned cycles in series for a total run time of 8 minutes. Other duty cycles can be programmed into the controller 106 to vary the fluid delivery, the fluid mixing through the mixing valve 46, agitation, and suction dwell times. Further, the duty cycles can include a non-powered dwell time wherein the fluids are allowed to penetrate and work on the spot while all other functions are temporarily suspended. At a convenient time for the user, the user returns to the unattended spot cleaning apparatus 500, unplugs the power cord, removes the recovery tank assembly 508 from the top housing 504, and cleans the recovery tank assembly 508.

The preferred invention has been described as an unattended spot cleaning apparatus. It can also be appreciated that several subsets of the invention can be recombined in new ways to provided various configurations. Any combination of a floor condition sensor system, fluid distribution system, fluid recovery system, or agitation system can be used to solve specific cleaning problems not requiring all the capabilities of all the subsystems herein described. As can be appreciated, the duty cycle can be configured in any combination desired to vary the agitation direction and duration. The agitator can be controlled to rotate in one direction and then reverse direction so that the bristles contact an opposite side of the carpet fiber resulting in improved cleaning performance.

While the invention has been specifically described in connection with certain specific embodiments thereof, it is to be understood that this is by way of illustration and not of limitation. For example, the invention can be practiced with a single fluid tank as well as multiple fluid tanks with a mixer for the fluids from the multiple fluid tanks. Reasonable variation and modification are possible within the scope of the forgoing description and drawings without departing from the scope of the invention that is described in the appended claims.

I claim:

1. A floor cleaning apparatus comprising:

a housing with a bottom portion that is adapted to rest on a surface being cleaned and an opening in an underside of the housing to define an enclosed chamber between the surface to be cleaned and an interior portion of the housing;

a carriage support mounted in the enclosed chamber in the housing above the opening in the underside of the housing;

an extraction system including a suction nozzle for recovering soil from the surface to be cleaned beneath the opening in the underside of the housing and a suction source having an inlet fluidly connected to the suction nozzle to create a working air flow;

a carriage mounting the suction nozzle to the carriage support for translational movement with respect to the housing so that the suction nozzle moves laterally with respect to the housing and along the surface to be cleaned;

a working air path that carries working air to the suction source from the suction nozzle; and an exhaust air passage between an outlet of the suction source and the enclosed chamber.

2. A floor cleaning apparatus comprising:

a housing with a bottom portion that is adapted to rest on a surface being cleaned;

a carriage support above an opening in an underside of the housing;

a fluid delivery system mounted to the housing and including a fluid distributor for delivering a cleaning fluid to the surface to be cleaned beneath the opening in the underside the housing;

a fluid extraction system including a suction nozzle for recovering soiled cleaning fluid from the surface to be cleaned beneath the opening in the underside of the housing;

a carriage mounting the fluid distributor and the suction nozzle to the carriage support for movement with respect to the housing so that the suction nozzle and the fluid distributor move laterally with respect to the surface to be cleaned;

a motor mounted to the housing and connected to the carriage for driving the movement of the carriage with respect to the housing; and a controller for selectively controlling the direction of movement the motor for sequential movement in two mutually exclusive directions.

3. A floor cleaning apparatus according to claim 2 wherein the movement is arcuate.

4. A floor cleaning apparatus according to claim 2 and further including a scrubbing implement mounted to the carriage for movement with the fluid distributor and the suction nozzle and for scrubbing contact with the surface to be cleaned.

* * * * *